US010488132B2

(12) United States Patent
Full

(10) Patent No.: US 10,488,132 B2
(45) Date of Patent: Nov. 26, 2019

(54) FOLDING PISTOL

(71) Applicant: Full Forward Technologies LLC, Las Vegas, NV (US)

(72) Inventor: Michael Full, Dublin, CA (US)

(73) Assignee: FULL FORWARD TECHNOLOGIES LLC, Las Vegas, NV (US)

( * ) Notice: Subject to any disclaimer, the term of this patent is extended or adjusted under 35 U.S.C. 154(b) by 0 days.

(21) Appl. No.: 16/439,649

(22) Filed: Jun. 12, 2019

(65) Prior Publication Data

US 2019/0331445 A1 Oct. 31, 2019

Related U.S. Application Data

(63) Continuation-in-part of application No. 16/366,264, filed on Mar. 27, 2019, which is a continuation of application No. 16/043,499, filed on Jul. 24, 2018, now Pat. No. 10,274,276.

(60) Provisional application No. 62/537,466, filed on Jul. 27, 2017, provisional application No. 62/684,678, filed on Jun. 13, 2018.

(51) Int. Cl.
*F41A 11/04* (2006.01)

(52) U.S. Cl.
CPC ..... *F41A 11/04* (2013.01)

(58) Field of Classification Search
CPC ..... F41A 11/04
See application file for complete search history.

(56) References Cited

U.S. PATENT DOCUMENTS

| | | | | |
|---|---|---|---|---|
| 8,006,425 | B2 * | 8/2011 | Burt | F41A 3/66 42/1.09 |
| 9,945,629 | B2 * | 4/2018 | Osborne | F41A 9/17 |
| 2010/0242329 | A1 | 9/2010 | Carr et al. | |

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A folding pistol has an elongated trigger bar movable between a bar rear position in which discharge of the firearm is disabled, and a bar forward position operable to discharge the firearm, a trigger body connected to the trigger bar and movable between a first body position in which the trigger bar is maintained in the bar rear position and a second body position in which the trigger bar is in the bar forward position, a trigger lever movable with respect to the body between an extended position in which the trigger lever depends downwardly away from the frame and a folded position in which the trigger lever extends forward along the frame, and the trigger lever having a first body contact surface configured to restrain the trigger body in the first body position when the trigger lever is in the folded position, such that discharge is prevented.

20 Claims, 17 Drawing Sheets

FOLDING PISTOL

CROSS-REFERENCE TO RELATED APPLICATION

This application is a Continuation-in-Part of U.S. patent application Ser. No. 16/366,264 filed on Mar. 27, 2019, entitled "FOLDING PISTOL," which is a Continuation of U.S. patent application Ser. No. 16/043,499, now issued as U.S. Pat. No. 10,274,276, filed on Jul. 24, 2018, entitled "FOLDING PISTOL," which claims the benefit of U.S. Provisional Patent Application No. 62/537,466 filed on Jul. 27, 2017, entitled "FOLDING HANDGUN & GRIP EXTENSION SECTIONS," and also claims the benefit of U.S. Provisional Patent Application No. 62/684,678 filed on Jun. 13, 2018, entitled "FOLDING SAFETY TRIGGER," which are hereby incorporated by reference in their entirety for all that is taught and disclosed therein.

FIELD OF THE INVENTION

The present invention relates to firearms, and more particularly to a pistol that folds into a compact shape for storage or transport that is not readily identifiable as a handgun. The folding capability also provides a large physical and visual safety mechanism when the pistol is in the folded condition that supplements an additional mechanical safety that functions when the pistol is partially or fully unfolded.

BACKGROUND OF THE INVENTION

Concealed carry is the practice of carrying a firearm, usually a handgun, in public in a concealed manner. All 50 states in the US have laws allowing qualified individuals to carry certain concealed firearms in public, either without a permit or after obtaining a permit. Published statistics indicate the number of concealed carry permit holders in the United States is steadily increasing.

Small caliber and small frame handguns that will fit in a pocket are particularly popular for concealed carry. A significant disadvantage to these firearms is they are easily recognized as being a handgun in the carrier's pocket because of their very identifiable, distinct L-shaped pistol silhouette. In addition, because of their characteristic handgun form, they often turn and twist in different directions in the carrier's pocket, making a smooth draw awkward. Conventional pocket carry handguns when carried in a pocket unchambered with a holster apply pressure solely on the barrel in the pocket, which can break the pocket's seams. If a conventional pocket carry handgun is carried with a round chambered, the handgun must be carried inside a holster to prevent accidental discharge. Otherwise, the handgun could discharge if the user were to bump into something that could engage the trigger, such as a table corner, or if the trigger were inadvertently actuated when the user was retrieving the handgun from his or her pocket. The holster adds bulk and requires an additional removal step before the handgun can be operated. Additionally, small pocket carry handguns are often "snappy," having excess muzzle rise that makes maintaining the sight picture difficult, and the grips are often too small or awkward to grasp. Another negative aspect is the magazine capacity of small pocket carry firearms is generally limited to relatively few rounds because a higher capacity magazine may not fit in the user's pocket or can be harder to draw from the user's pocket. If an extra magazine is needed, it must be carried either in another pocket or a holster of some sort that requires the carrier to divert at least one hand and his or her attention to retrieve it and reload the handgun.

To attempt to address the identifiable, distinct silhouette of a concealed carry firearm, and to enable larger handguns with greater magazine capacities to be used for concealed carry, foldable handguns have been developed. One example is the compact foldable handgun disclosed by US Patent Publication No. 2010/0242329 to Carr et al. Although the handgun of Carr et al. is generally suitable for its intended use, it has the disadvantages of additional complexity and requiring the use of a specially-designed pistol. The Carr et al. trigger guard does not connect to the grip, the trigger supports the rear of the trigger guard, and the grip and trigger do not share a common pivot pin. In contrast, the grip and trigger of the current invention share a common pivot pin to reduce complexity, the trigger guard is connected to the grip, and the current invention is readily adaptable for use with an existing, conventional pistol.

Therefore, a need exists for a new and improved folding pistol that is not readily identifiable as a handgun, reduces complexity of the folding mechanism, can be used with existing, conventional pistols, and provides a large physical and visual safety mechanism when the pistol is in the folded condition. In this regard, the various embodiments of the present invention substantially fulfill at least some of these needs. In this respect, the folding pistol according to the present invention substantially departs from the conventional concepts and designs of the prior art, and in doing so provides an apparatus primarily developed for the purpose of not being readily identifiable as a handgun, reducing complexity of the folding mechanism, being used with existing, conventional pistols, and providing a large physical and visual safety mechanism when the pistol is in the folded condition.

SUMMARY OF THE INVENTION

The present invention provides an improved folding pistol, and overcomes the above-mentioned disadvantages and drawbacks of the prior art. As such, the general purpose of the present invention, which will be described subsequently in greater detail, is to provide an improved folding pistol that has all the advantages of the prior art mentioned above.

To attain this, the preferred embodiment of the present invention essentially comprises a firearm frame supporting a reciprocating slide and barrel, a grip pivotally connected to the frame and movable between an operational condition and a folded condition, an elongated trigger bar connected to the frame and movable between a bar rear position in which discharge of the firearm is disabled, and a bar forward position, with movement to the bar forward position operable to discharge the firearm, a trigger body connected to the trigger bar and movable between a first body position in which the trigger bar is maintained in the bar rear position and a second body position in which the trigger bar is in the bar forward position, a trigger lever movable with respect to the body between an extended position in which the trigger lever depends downwardly away from the frame and a folded position in which the trigger lever extends forward along the frame, and the trigger lever having a first body contact surface configured to restrain the trigger body in the first body position when the trigger lever is in the folded position, such that discharge is prevented. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
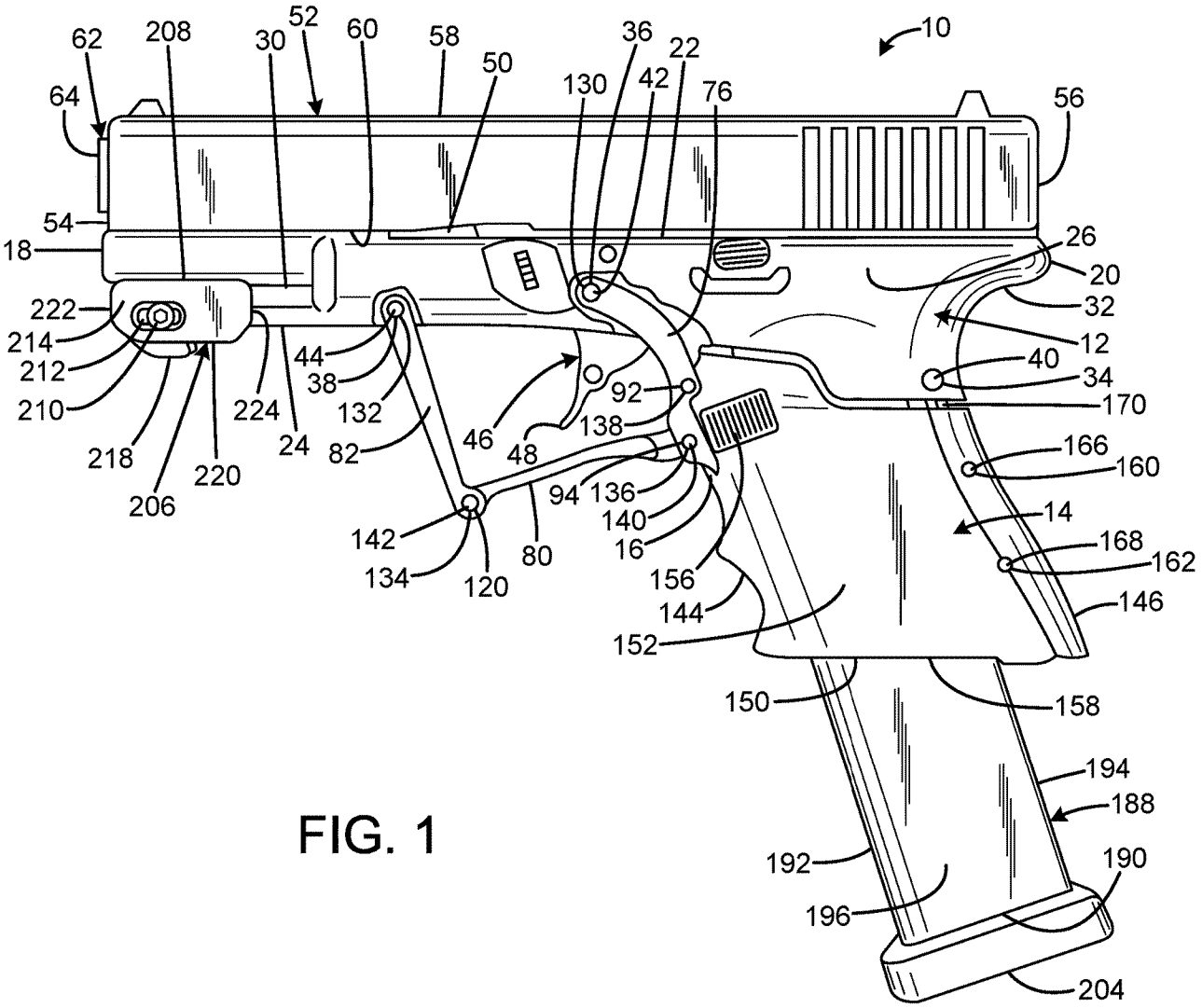
FIG. 1 is a left side view of the current embodiment of the folding pistol constructed in accordance with the principles of the present invention with the grip in the extended position, which makes the pistol operable to fire.

An embodiment of the folding pistol of the present invention is shown and generally designated by the reference numeral 10.

FIGS. 1-7 illustrate the improved folding pistol 10 of the present invention. More particularly, in the current embodiment, the folding pistol is a modified Glock 19 Gen4 pistol manufactured by Glock, Inc of Smyrna, GA. This type of pistol has a 1-piece integrally molded plastic planar frame 12 including a unitary molded plastic handgrip 14 with a curved exterior to be comfortably received in a user's hand and a trigger guard 16. The folding pistol of the present invention detaches the handgrip from the frame, cuts off most of the trigger guard to leave only a small stub on the handgrip, and adds numerous slots and apertures that will be described subsequently.

Figure 3:
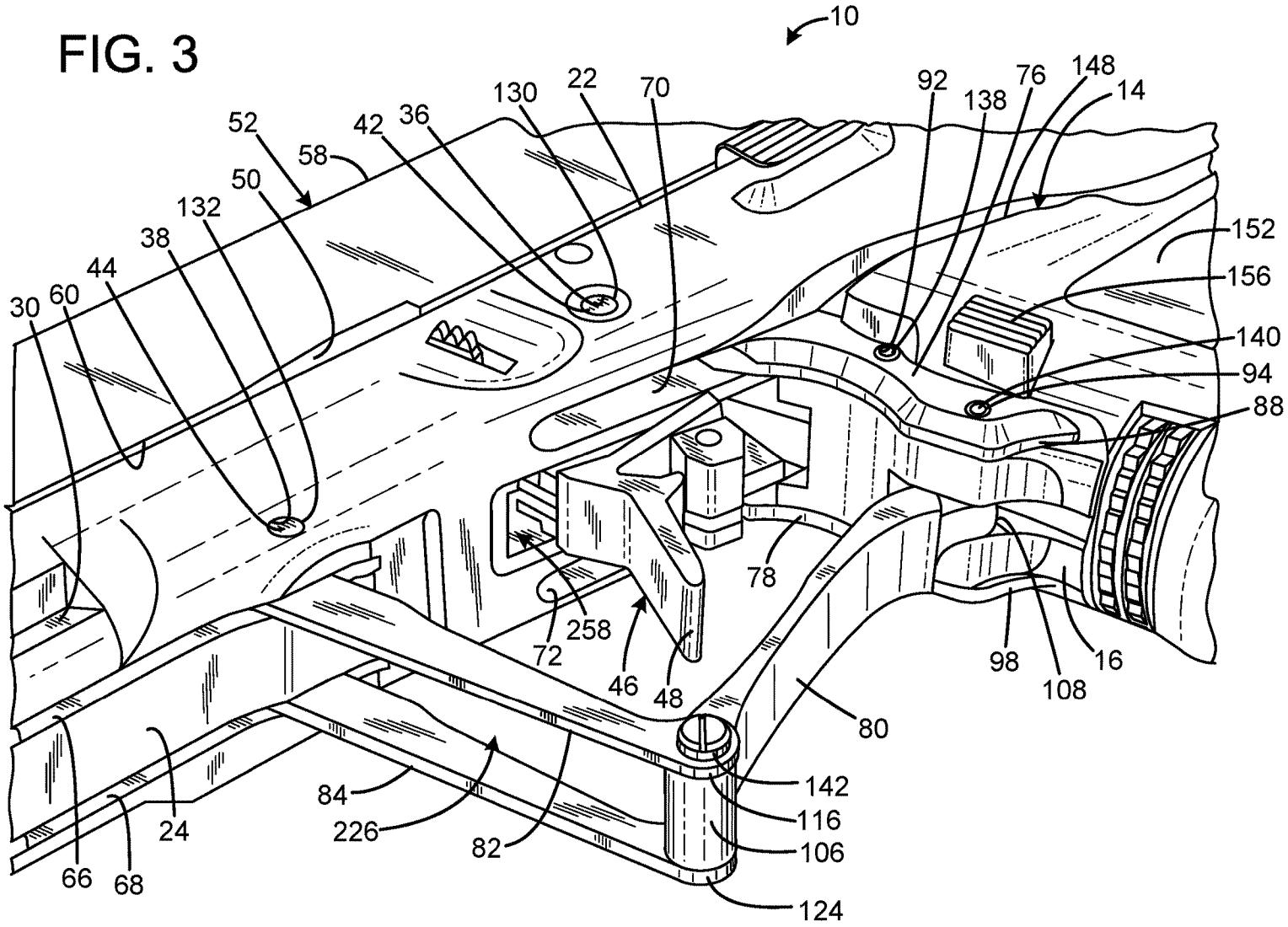
FIG. 3 is an enlarged front perspective view of the folding pistol of FIG. 1 with the grip in the extended position, which makes the pistol operable to fire.

FIGS. 1 & 3 show the folding pistol 10 with the handgrip 14 in the extended position in which the pistol is operable. The frame 12 has a front 18, rear 20, top 22, bottom 24, left side 26, and right side 28. The bottom front of the frame defines a rail 30. The bottom rear of the frame defines a beavertail 32. The left and right sides of the frame define apertures 34, 36, 38 that receive pins 40, 42, 44. Aperture 38 and pin 44 are added to the frame. Apertures 34, 36 and pins 40, 42 are pre-existing. Pin 42 attaches a trigger 46 to the frame. The trigger includes a free end 48. The top of the frame forms slide rails 50. A slide 52 is slidably mounted on the slide rails. The slide has a front 54, rear 56, top 58, and bottom 60. A barrel 62 having a muzzle 64 protrudes from the front of the slide. The bottom of the frame defines slots 66, 68 located in front of the trigger and slots 70, 72 on either side of the trigger.

The handgrip 14 is pivotally attached to the bottom 24 rear 20 of the frame 12 by a trigger guard assembly 74. The trigger guard assembly has a left rearward trigger guard element 76, right rearward trigger guard element 78, lower trigger guard element 80, left forward trigger guard element 82, and right forward trigger guard element 84. The left rearward trigger guard element has a top 86 and bottom 88. The top of the left rearward trigger guard element defines an aperture 90, and the bottom of the left rearward trigger guard element defines apertures 92, 94. The right rearward trigger guard element has a top 96 and bottom 98. The top of the right rearward trigger guard element defines an aperture 100, and the bottom of the right rearward trigger guard element defines apertures 102, 104. The lower trigger guard element has a front 106 and rear 108. The front of the lower trigger guard element defines an aperture 110, and the rear of the lower trigger guard element defines an aperture 112. The left forward trigger guard element has a top 114 and bottom 116. The top of the left forward trigger guard element defines an aperture 118, and the bottom of the left forward trigger guard element defines an aperture 120. The right forward trigger guard element has a top 122 and bottom 124. The top of the right forward trigger guard element defines an aperture 126, and the bottom of the right forward trigger guard element defines an aperture 128.

The trigger guard assembly 74 is a four-bar linkage having a first pivot 130, second pivot 132, third pivot 134, and fourth pivot 136. The first pivot includes the tops 86, 96 of the left and right rearward trigger guard elements 76, 78, pin 42, and trigger 46. Thus, the trigger is connected to the frame at the first pivot. The handgrip 14 is connected to the first pivot by the bottoms 88, 98 of the left and right rearward trigger guard elements. The bottoms of the left and right rearward trigger guard elements are secured to the handgrip by pins 138, 140 inserted through apertures 92, 94, 102, 104 in the left and right rearward trigger guard elements and apertures 248, 250 added to the small stub of the original trigger guard 16. The second pivot includes the tops 114, 122 of the left and right forward trigger guard elements 82, 84 and pin 44 (apertures 118 and 126 are the pivot points). The third pivot includes the bottoms 116, 124 of the left and right forward trigger guard elements, the front 106 of the lower trigger guard element 80, and screws 142, 252. The fourth pivot includes the rear 108 of the lower trigger guard element 80, the bottoms 88, 98 of the left and right rearward trigger guard elements, and pin 140. Thus, the lower trigger guard element is connected to the handgrip 14 at the fourth pivot. In the current embodiment, the first, second, third, and fourth pivots are at different locations. The free end 48 of the trigger is not connected to any points of the pivoting linkage, so the free end of the trigger is disconnected from the left and right forward trigger guard elements and the lower trigger guard element.

The handgrip 14 has a front strap 144, back strap 146, top 148, bottom 150, left side 152, and right side 154. The top of the left side includes a magazine latch 156 in the current embodiment. However, the magazine latch can also be on the top of the right side. The bottom of the handgrip is a free end extending away from first pivot 130. The top and bottom of the handgrip are opposed open ends defining a hollow interior magazine passage 158. The top open end of the handgrip is proximate the first pivot. The back strap defines apertures 160, 162 and slot 164, which are added. Apertures 160, 162 receive pins 166, 168. Pin 166 pivotally mounts a rear latch 170 within the slot. The rear latch has a top 172, bottom 174, front 176, and rear 178. The top front of the rear latch defines an angled surface 180 and a forward-facing notch 182. A spring 184 biases the latch such that the notch is urged forward.

The magazine passage 158 receives the top 186 of a magazine 188. In the current embodiment, the magazine is a 21-round magazine manufactured by Magpul Industries Corp. of Austin, Tex. However, any conventional, unmodified magazine suitable for use with the Glock 19 Gen4 pistol can be used, including the Glock 33 round magazine. The magazine also has a bottom 190, front 192, rear 194, and left side 196. The top of the magazine defines feed lips 198 that restrain cartridges 200. The front left of the magazine below the feed lips defines a magazine catch 202. The front right of the magazine below the feed lips defines a second magazine catch (not visible) for use when the magazine latch is located on the right side 154 of the handgrip 14. The top 148 open end of the handgrip is adapted to receive the magazine having a magazine catch with the magazine latch 156 beyond the magazine catch in a direction away from the bottom 150 free end of the handgrip. When the magazine is received within the magazine passage 158 with the handgrip in the extended position as shown in FIG. 1, the magazine latch 156 is received by the catch to releasably retain the magazine within the magazine passage. A base plate 204 is attached to the bottom of the magazine.

The top 208 of a retaining element 206 is attached to the rail 30 on the front 18 of the frame 12 by screws 210 received in slots 212 defined in the left side 214 and right side 216 of the retaining element and threadedly engaged with a hexagonal bar 228. The hexagonal bar is received by a slot 254 in the rail to prevent movement of the retaining element relative to the bar. A tooth 218 protrudes downward from the bottom 220 of the retaining element. The tooth passively retains the handgrip 14 in the stowed position. The position of the tooth is adjustable depending upon the location of screws 210 within the slots, which can be adjusted if the user wants to make it easier or harder to pull the handgrip into the extended position. The retaining element also has a front 222 and rear 224.

Figure 2:
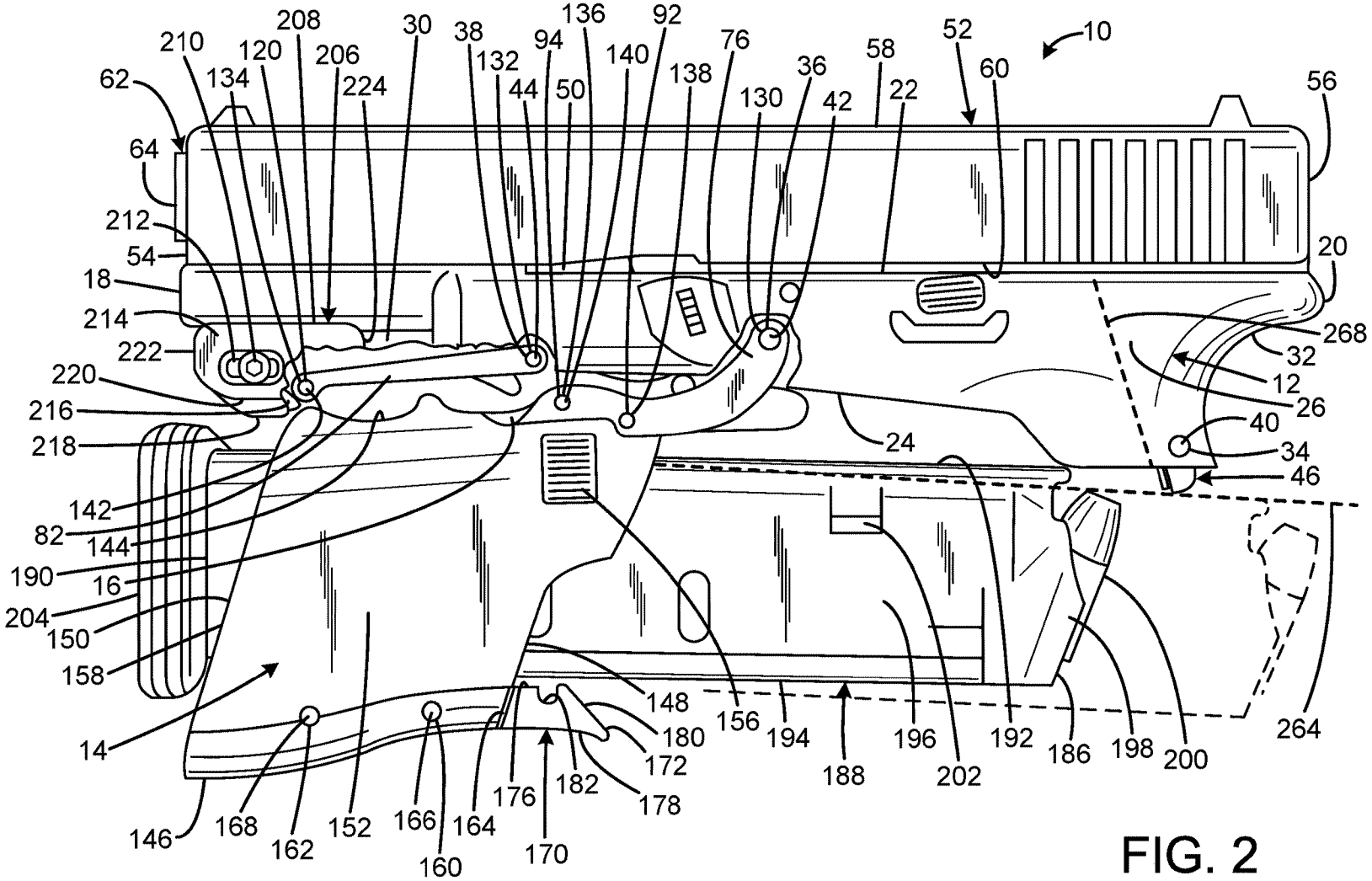
FIG. 2 is a left side view of the folding pistol of FIG. 1 with the grip in the stowed position, which makes the pistol safe and incapable of firing.

FIG. 2 illustrates the improved folding pistol 10 of the present invention. More particularly, the folding pistol is shown with the handgrip 14 in the stowed position in which the bottom 150 free end of the handgrip is adjacent the frame 12 and the pistol is inoperable. The slots 66, 68 in the bottom 24 of the frame 12 enable the left and right forward trigger guard elements 82, 84 to pivot clockwise about second pivot 132 to transition the handgrip from the extended position to the stowed position. The left and right forward trigger guard elements are a pair of spaced-apart straight elongated spans defining a gap 226. The lower trigger guard element 80 is a bar having a width sized to be received in the gap when the handgrip is in the stowed position. The slot 70, 72 in the bottom of the frame on either side of the trigger 46 enable the right and left rearward trigger guard elements 76, 78 to pivot clockwise about the first pivot 130 to transition the handgrip from the extended position to the stowed position. When the handgrip is in the stowed position, the trigger 46 folds upward into a safe position that prevents actuation of the trigger mechanism when the folding pistol is folded. Specifically, the front face of the trigger has a groove that prevents the trigger housing from moving the trigger bar 262 (shown in FIG. 7) with the handgrip in the stowed position. Therefore, as long as the trigger face is fully folded, it is mechanically impossible for the trigger bar to move to discharge the folding pistol. With the handgrip in the stowed position, the folding pistol no longer resembles a conventional L-shaped handgun. Instead, the folding pistol has a generally rectangular appearance with approximately the length and width of a large smart cellular phone. As a result, when the folding pistol is concealed, the silhouette of the folding pistol is unlikely to draw attention. The folding pistol also distributes its weight across the pocket's seams, decreasing the chance the pocket's seams will break. Furthermore, the folding pistol has a much higher capacity magazine 188 than traditional firearms considered suitable for concealed carry, especially in a pocket. A conventional sub-compact pocket carry pistol with 10 rounds has a larger rectangular footprint than the folding pistol with 21 rounds with the handgrip in the stowed position. The folding pistol also offers several advantages compared to traditional waistband concealed carry. Waistband concealed carry involves four components: a pistol (typically having a limited magazine capacity), pistol holster, spare magazine, and magazine holder. The folding pistol eliminates the need for a holster, spare magazine, and magazine holder because of its inherently safe condition when folded and its ability to accommodate high capacity magazines that decrease the need to reload. The folding pistol also provides a smaller, rectangular footprint and is thinner than a conventional pistol suitable for waistband concealed carry.

In the stowed position, the magazine passage 158 of the handgrip 14 has a selected surface facing away from the frame 12 when the handgrip is in the stowed position denoted by the forward portion of dashed line 264. The rear portion of the dashed line 264 beyond the top 148 of the handgrip 14 denotes a surface against which the top 186 of the magazine 188 slides to guide the magazine into position when the handgrip is unfolded. In the stowed position, the frame has a rear portion rearward of the first pivot 130, and the entire rear portion remains above the selected surface of the magazine passage of the handgrip, such that the elongated magazine 188 in the magazine passage, or an even higher capacity magazine denoted by the dashed lines, can extend below the frame. It should be appreciated that the frame and parts such as the housing portion of the trigger 46 can flex to enable the top of a 33 round magazine to extend beyond the rear of the frame. Contact between the housing portion of the trigger and a high capacity magazine produces some friction when the high capacity magazine is stored this way so the stop element 230 is not required, and a user can switch the handgrip from the stowed position to the extended position with one hand.

To transition the handgrip 14 from the extended position to the stowed position, the user depresses the bottom 174 of the rear latch 170 to disengage the notch 182 from pin 40. The user can then pivot the handgrip clockwise about first pivot 130 into the stowed position. The tooth 218 snaps over the front 106 of the lower trigger guard element 80 to releasably secure the handgrip in the stowed position. For any magazines where the baseplate extends beyond the muzzle, such as the Glock 15 magazine, a Magpul 21 magazine, or a Glock 33 magazine, the user depresses the magazine latch 156 to disengage the magazine latch from the catch 202 on the magazine 188 and slides the magazine upwards until the baseplate contacts the bottom 150 of the handgrip. In this position, the magazine forms a rectangular footprint with the folded pistol. When the magazine is stored in this position, the magazine latch 156 is maintained in a depressed position by the magazine's body. So, when the magazine comes back down as the handgrip transitions from the stowed position to the extended position, the magazine latch will spring back into the magazine catch 202 and lock the magazine. This action prevents the magazine from falling out of the handgrip while the folding pistol is being transported or unfolded.

To transition the handgrip 14 from the stowed position to the extended position, the user pivots the handgrip counter-clockwise about first pivot 130 to disengage the tooth 218 from the front 106 of the lower trigger guard element 80 and position the handgrip in the extended position. As the user unfolds the handgrip, the magazine passage 158 smoothly guides the magazine 188 downward as the top 186 of the magazine enters the bottom 24 of the frame 12 and contacts the back wall of the magazine well (dashed line 268). Eventually, the top of the magazine reaches a proper operational position with the magazine latch 156 being received in the catch 202 to ensure the feed lips 198 are located at the proper height to feed the uppermost cartridge 200 into the folding pistol 10 through feed passage 256. The angled surface 180 on the rear latch 170 acts as a cam surface to push the top of the rear latch rearward as the handgrip is raised until the spring can urge the forward-facing notch 182 into engagement with the pin 40 to releasably secure the handgrip to the frame 12.

Figure 4:
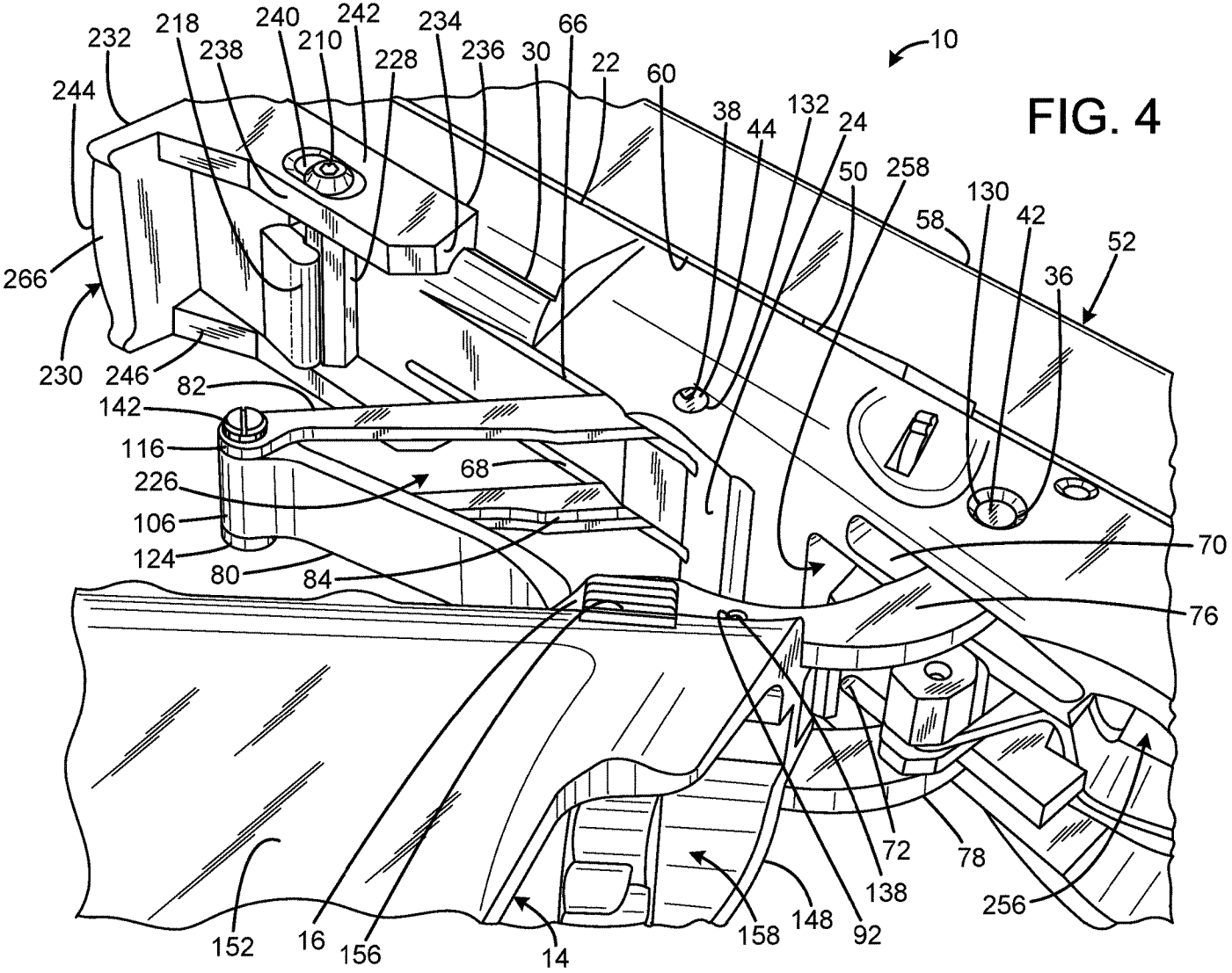
FIG. 4 is an enlarged rear perspective view of the folding pistol of FIG. 1 with the grip partially folded into the stowed position, which makes the pistol safe and incapable of firing. The magazine of FIG. 1 has been removed to expose various features of the folding pistol.
Figure 5:
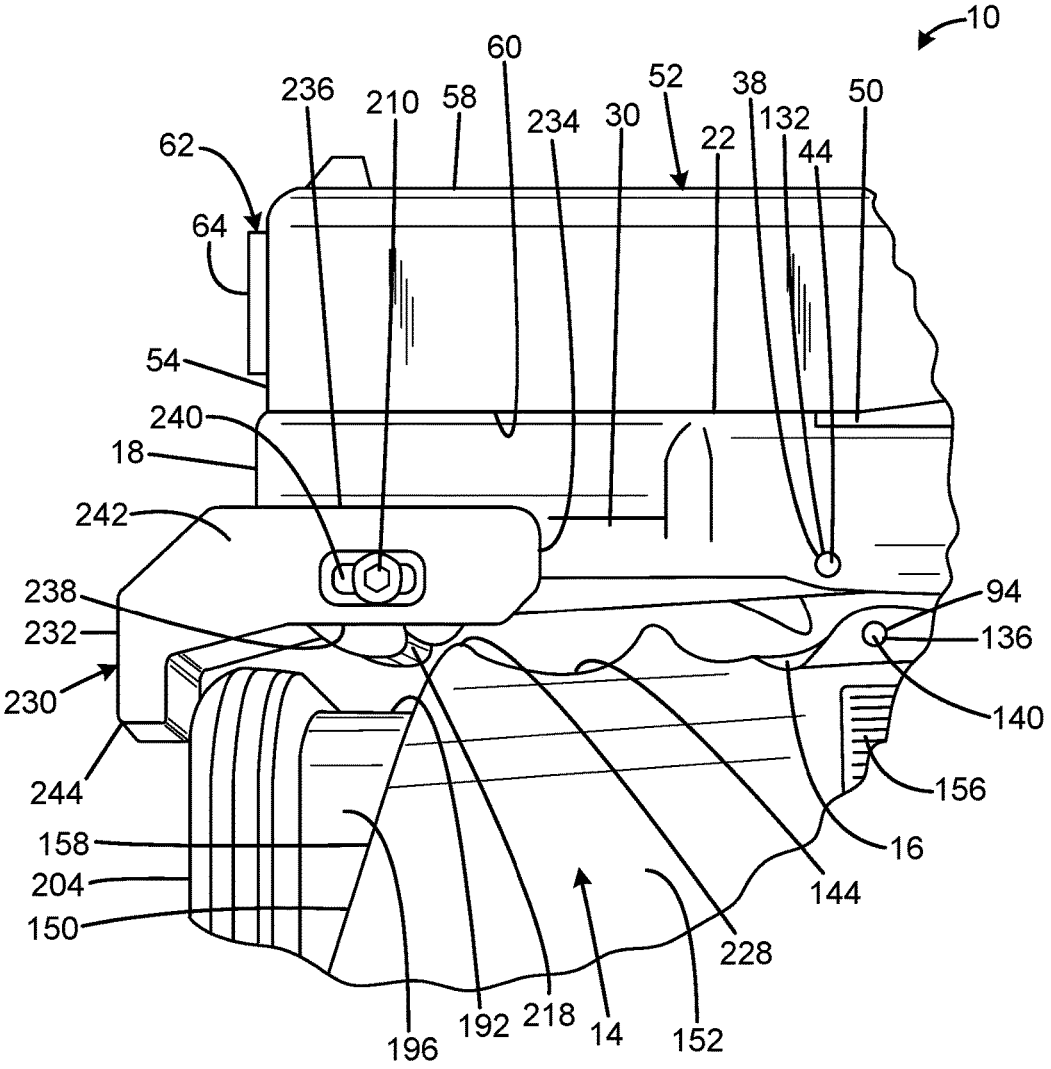
FIG. 5 is an enlarged left side view of the folding pistol of FIG. 1 with an optional stop element installed. The stop element is an optional latch element that prevents the magazine from dropping, the grip from opening, and serves as an offset so the gun does not go out of battery if pressed against an object (such as a body).
Figure 6:
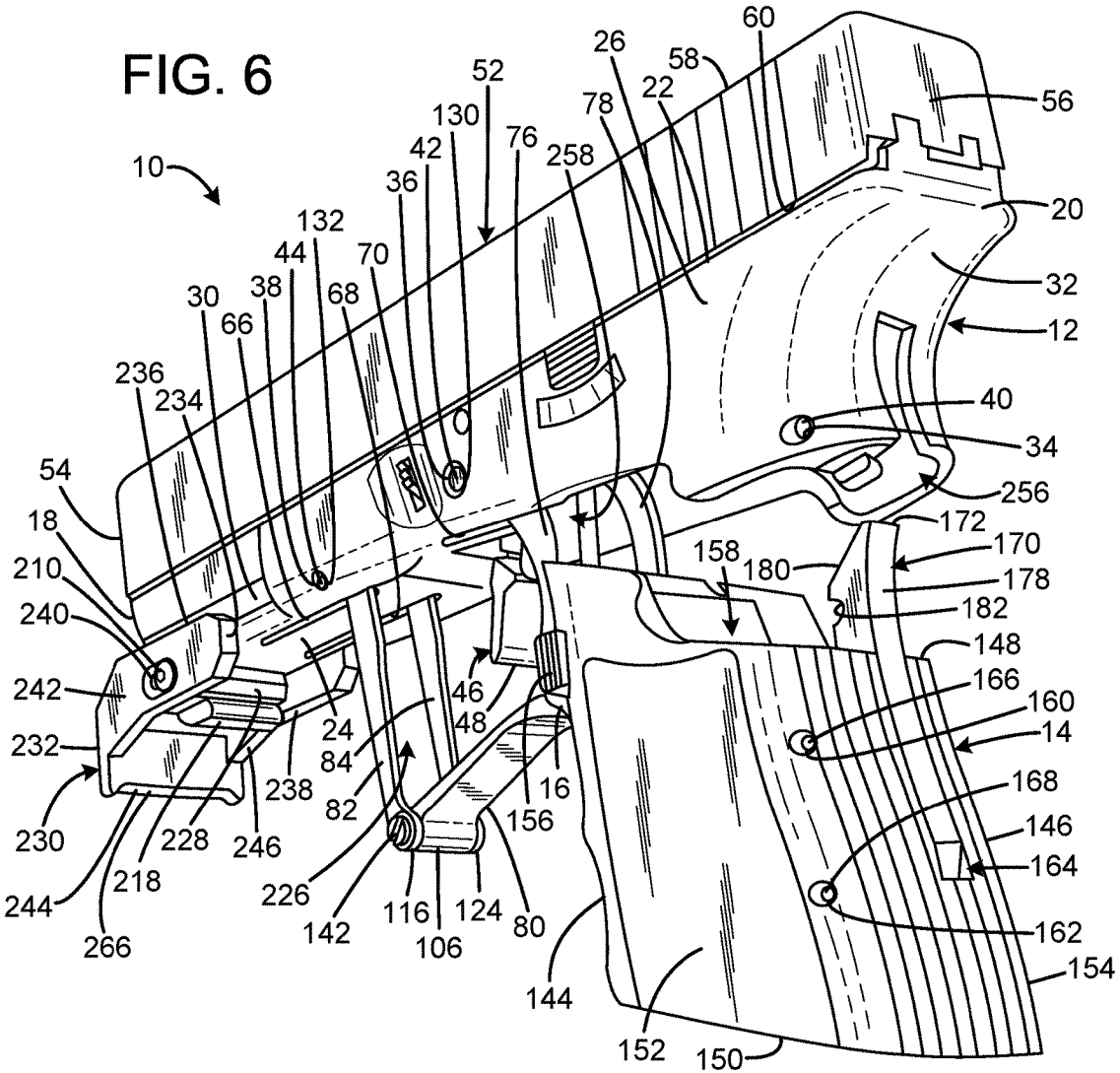
FIG. 6 is a rear perspective view of the handgrip and rear latch of the folding pistol of FIG. 1.
Figure 7:
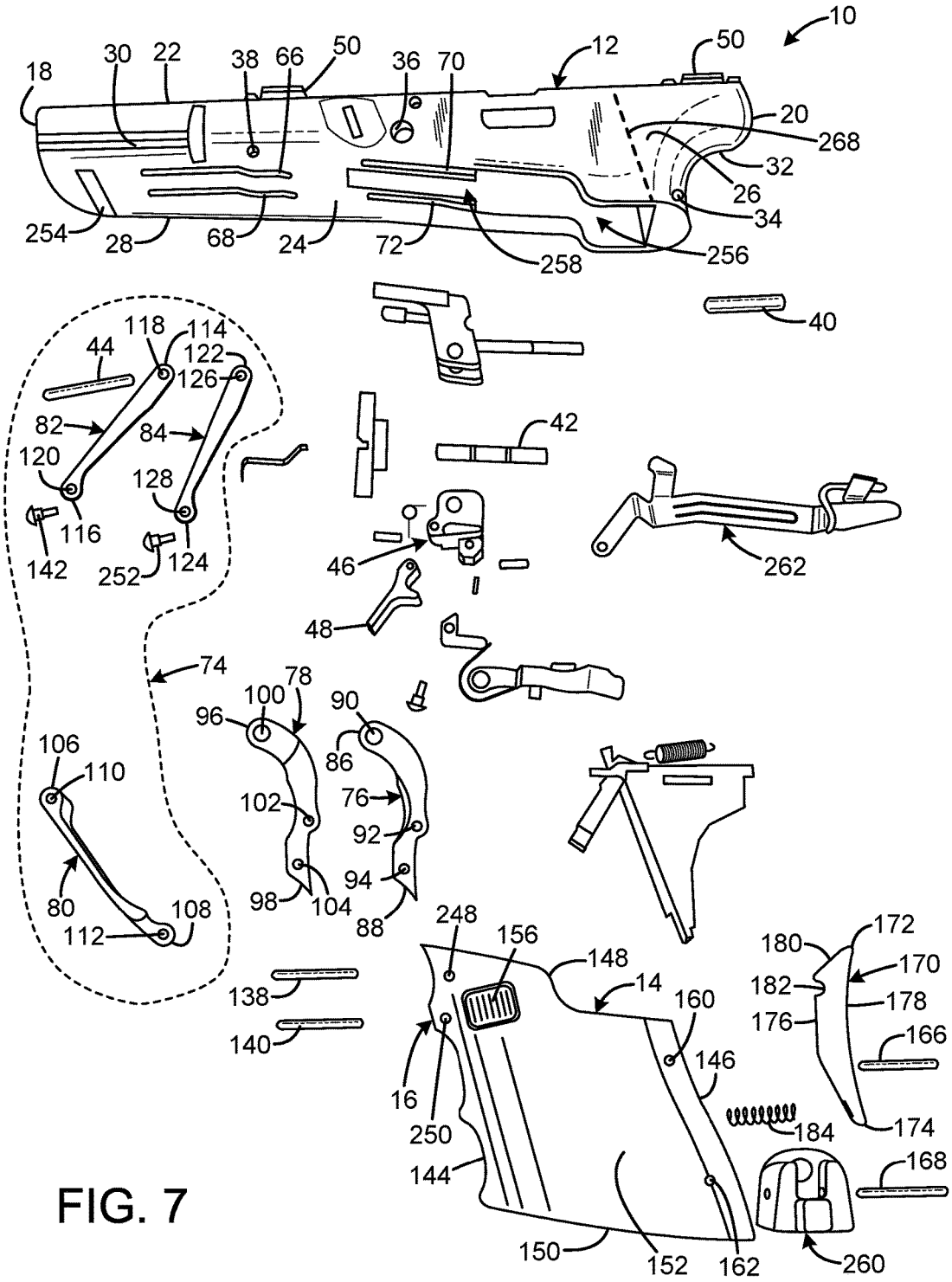
FIG. 7 is an exploded view of the folding pistol of FIG. 1.

FIGS. 4-6 illustrates the improved folding pistol 10 of the present invention. More particularly, the folding pistol is shown with an optional stop element 230 incorporated into the retaining element 206. The handgrip 14 is shown partially folded in FIG. 4, in the stowed position in FIG. 5, and partially folded in FIG. 6. The stop element has a front 232, rear 234, a top 236, and bottom 238. The stop element defines slots 240 in the left side 242 and right side 246 that receive screws 210. A protrusion 244 extends downward from the bottom front of the stop element. The bottom of the protrusion defines a groove 266. When the handgrip is in the stowed position, the protrusion contacts the baseplate 204 of the magazine 188 to prevent the magazine from moving forward beyond the protrusion. Thus, the stop element is connected to a forward portion 18 of the frame 12 away from the handgrip 14 and is adapted to extend below the frame to limit movement of the magazine in the handgrip past the muzzle when the handgrip is in the stowed position. The stop element is connected to the rail 30. Contact between the baseplate and bottom 150 of the handgrip limits upward movement of the magazine within the magazine passage. When a higher capacity 33 round magazine is used, the groove in the bottom of the stop element enables the baseplate of the higher capacity magazine to pass over the stop element. However, the stop element still helps keep the folding pistol in the stowed position and provides additional friction to keep higher capacity magazines from moving.

In the current embodiment, the first and second pivot 130, 132 define a first link length, the second and third pivot 132, 134 define a second link length, the third and fourth pivot 134, 136 define a third link length, and the fourth and first pivots 136, 130 define a fourth link length. In the current embodiment, the distance between the first and second pivots is 1.417 inch, the distance between the second and third pivots is 1.491 inch, the distance between the third and fourth pivots is 1.647 inch, and the length between the fourth and first pivots is 1.286 inch. Thus, the length of the longest of the link lengths exceeds the length of the least of the link lengths by less than 30% (28.07%). When the handgrip 14 is in the extended position, the third pivot is at a level below the fourth pivot. When the handgrip is in the extended position, the third pivot is spaced apart from the frame 12 by a greater distance than the fourth pivot is spaced apart from the frame. When the handgrip is in the extended position, the lower trigger guard element 80 is angled away from the frame, with the rear end 108 closer to the frame 12 than a forward end 106. The frame has a lower surface forward of the second pivot, and the left and right forward trigger guard elements 82, 84 remain below the lower surface when in the stowed position. The forward trigger guard elements underlay the lower surface when in the stowed position.

To manufacture the folding pistol 10, a CNC mill is used to modify a standard factory Glock 19 Gen4 frame using the following steps:

- Secure the Glock frame 12 to a fixture (vise) using the slide rails 50;
- Cut two slots 66, 68 on the bottom front of the frame and drill one hole 38 that will be the connection point of the two forward trigger guard elements 82, 84 that fold partially into the frame in the stowed position;
- Cut two slots 70, 72 for the pivot arms 76, 78 to be inserted into the frame.
- Widen the trigger pass through hole 258 in the frame to accommodate the larger folding trigger 46;
- Cut off most of the factory trigger guard 16;
- Flatten the front part of the handgrip 14 where the original factory trigger guard was connected and drill two holes 248, 250 to provide a flat surface to mount the two rearward trigger guard elements 76, 78;
- Cut a slot 164 on the back strap 146 of the handgrip to accommodate the rear latch 170 that latches the handgrip to the frame;
- Drill two holes 160, 162 in the handgrip, one receiving pin 166 to hold the rear latch and be its pivot point (160) and the second hole (162) receiving pin 168 to capture a polymer rear latch plug 260 inserted into a hole (not visible) in the bottom 150 of the handgrip behind the magazine passage 158 that positions the latch spring 184 to keep the latch spring from moving and possibly falling out as well as keeping debris out;
- Cut the length of the original handgrip (this is optional depending on the model of the pistol), because when the pistol is folded into the stowed position, the bottom of the handgrip is flush with the muzzle 64 of the barrel 62;
- Cut the handgrip completely off;
- Deburr all the plastic fuzz around the cut areas on the frame; and
- Assemble the parts.

The folding pistol 10 uses the original factory Glock trigger components (including the trigger bar 262) by removing the factory polymer trigger shoe and reusing the remaining original factory Glock trigger components with the folding trigger 46. The folding pistol manufacturing process also shaves some plastic off the rear trigger housing in the area that surrounds the factory rear sear retaining pin so there is more space for the rear latch 170 to move.

Figure 8:
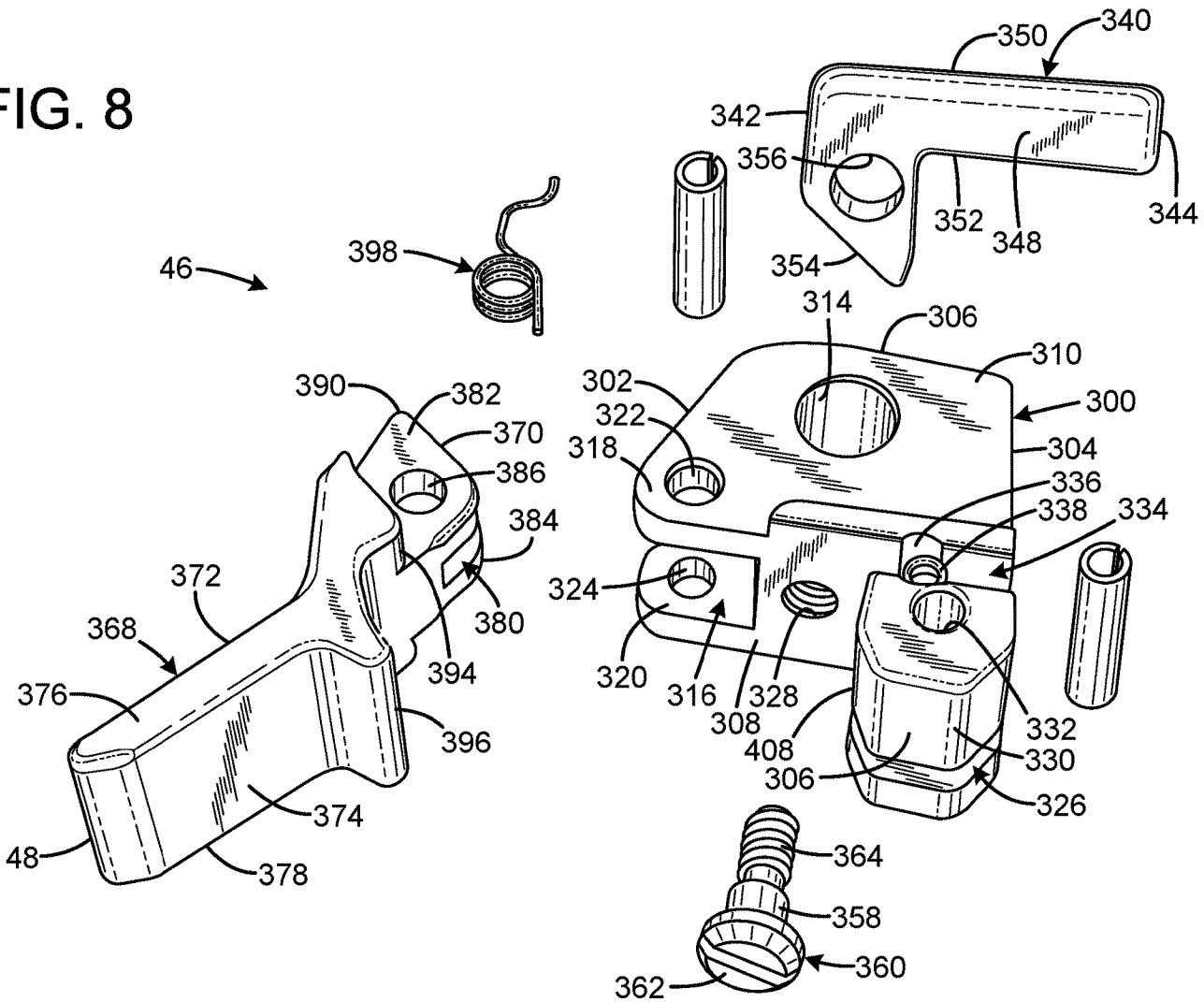
FIG. 8 is a rear exploded view of the trigger of FIG. 1.
Figure 9:
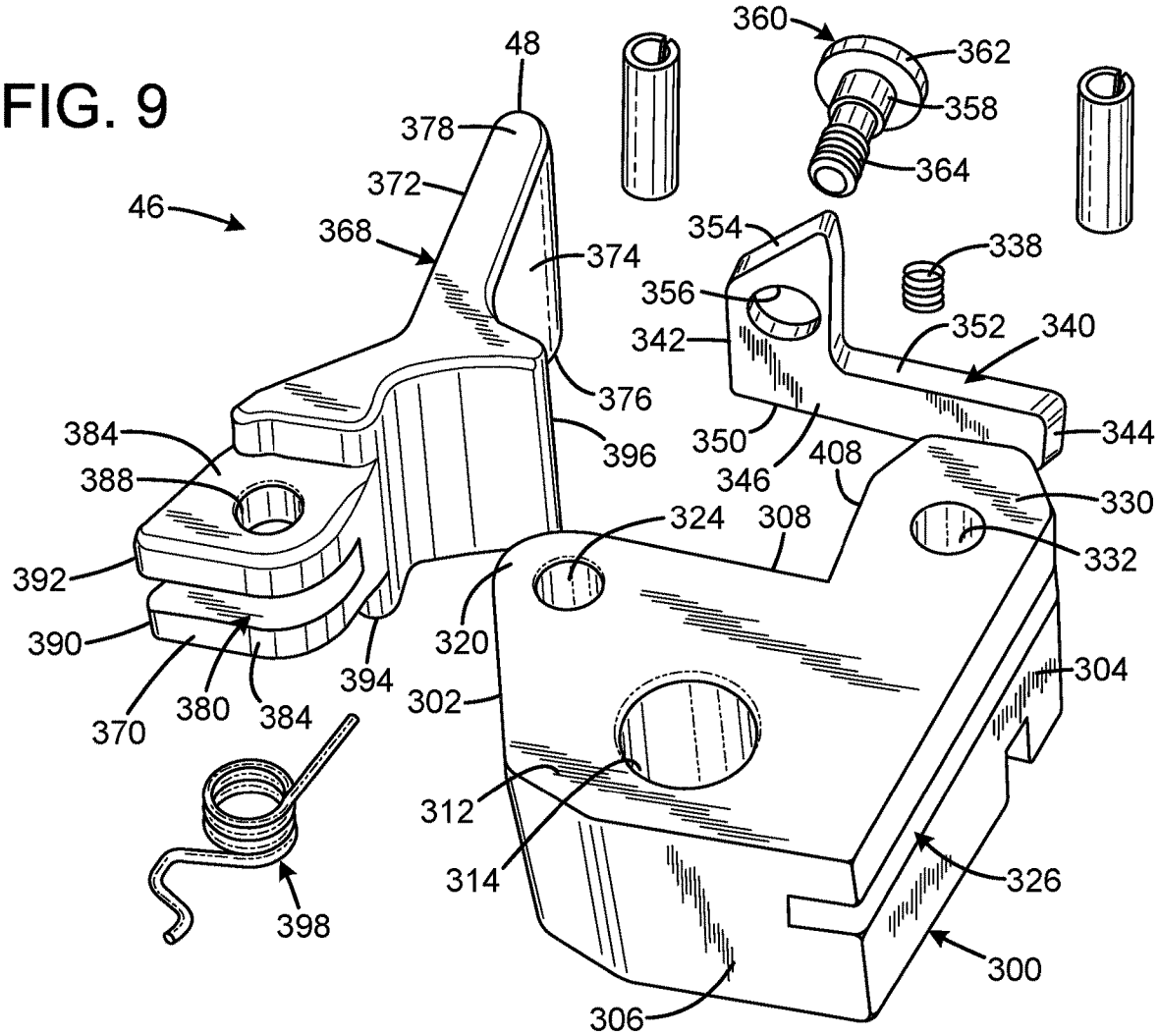
FIG. 9 is a top exploded view of the trigger of FIG. 1.

FIGS. 8 & 9 illustrate the improved folding trigger 46 of the present invention. More particularly, the folding trigger has a trigger lever 368 pivotally connected to a trigger body 300. The trigger body has a front 302, rear 304, top 306, bottom 308, left side 310, and right side 312. The trigger body defines a central transverse aperture 314 that receives pin 42. The front of the trigger body defines a trigger lever slot 316 that divides the front of the trigger body into a left ear 318 and a right ear 320. The left and right ears each define an aperture 322, 324. The rear of the trigger body defines a trigger bar slot 326. The bottom of the trigger body defines a threaded aperture 328. The bottom rear of the trigger body includes a downward-facing protrusion 330 that defines a portion of the trigger bar slot and defines a transverse aperture 332. The aperture at the forward end of the trigger bar 262 (shown in FIG. 7) attaches to the trigger body using aperture 332. The bottom left side of the trigger body defines a safety block element slot 334 just above the downward-facing protrusion. The bottom left side of the trigger body defines a transverse aperture 336 in communication with the safety block element slot that receives a coil spring 338.

A safety block element 340 is pivotally received within the safety block element slot 334. The safety block element has a front 342, rear 344, top 346, bottom 348, left side 350, and right side 352. The front of the safety block element includes a rightward extending protrusion 354 that defines a vertical aperture 356. The vertical aperture receives a shoulder portion 358 of a pivot screw 360. The pivot screw includes a head 362 located above the shoulder and a threaded portion 364 located below the shoulder. The threaded portion of the pivot screw is threadedly received by the threaded aperture 328 in the trigger body to releasably secure the safety block element within the safety block element slot. The shoulder portion of the pivot screw enables the safety block element to pivot about a vertical safety axis 366 (shown in FIG. 13) without binding.

The trigger lever 368 has a top 370 received within the trigger lever slot 316 of the trigger body 300. The trigger lever also has a front 372, rear 374, free end 48, left side 376, and right side 378. The top of the trigger lever defines a slot 380 that divides the top of the trigger lever into a left ear 382 and a right ear 384. The left and right ears each define an aperture 386, 388 that receive a pin to pivotally secure the trigger lever within the trigger lever slot. The top front of the left and right ears each define a first body contact surface 390, 392. The first body contact surface 390, 392 only contact the trigger body 300 when the pistol 10 is folded (or the trigger lever is folded up). The intention of the corner design of the first body contact surface 390, 392 is be a stop to how far the trigger lever can fold up so that a certain point, the trigger body will start moving with the trigger lever. If the first body contact surface 390, 392 did not have a corner and was instead round, then when the trigger lever is folded to the maximum extent, the trigger lever would not pull the trigger body forward. Since the trigger body is connect to the trigger bar 262, that is how folding the trigger lever locks the trigger bar in the forward position (while the trigger is fully folded and pinched between the handgrip 14 and frame 12). The left side of the trigger lever defines a rearward-facing convex safety block element contact surface 394 immediately below the left ear. The rear of the trigger lever defines a rearwardly protruding second body contact surface 396 below the safety block element contact surface. When the trigger lever is pulled, second body contact surface 396 closes gap 402 and contacts the front 408 of the downward-facing protrusion 330 on the trigger body 300. During this pull, the safety block element 340 would have retracted to allow movement of the trigger body rearward into the frame 12 to discharge the pistol 10.

Figure 10:
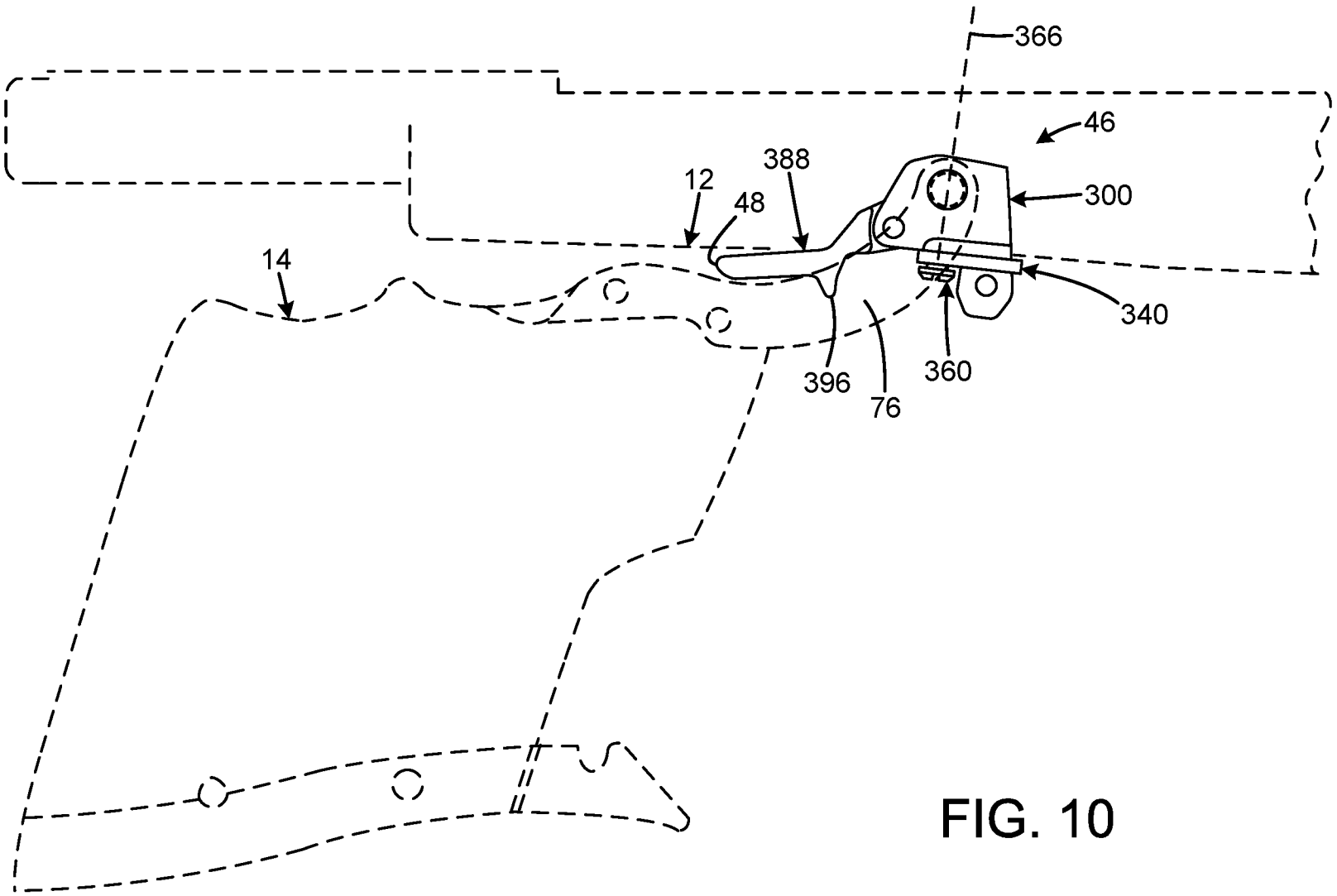
FIG. 10 is a side view of the trigger of FIG. 1 in the folded position.
Figure 11:
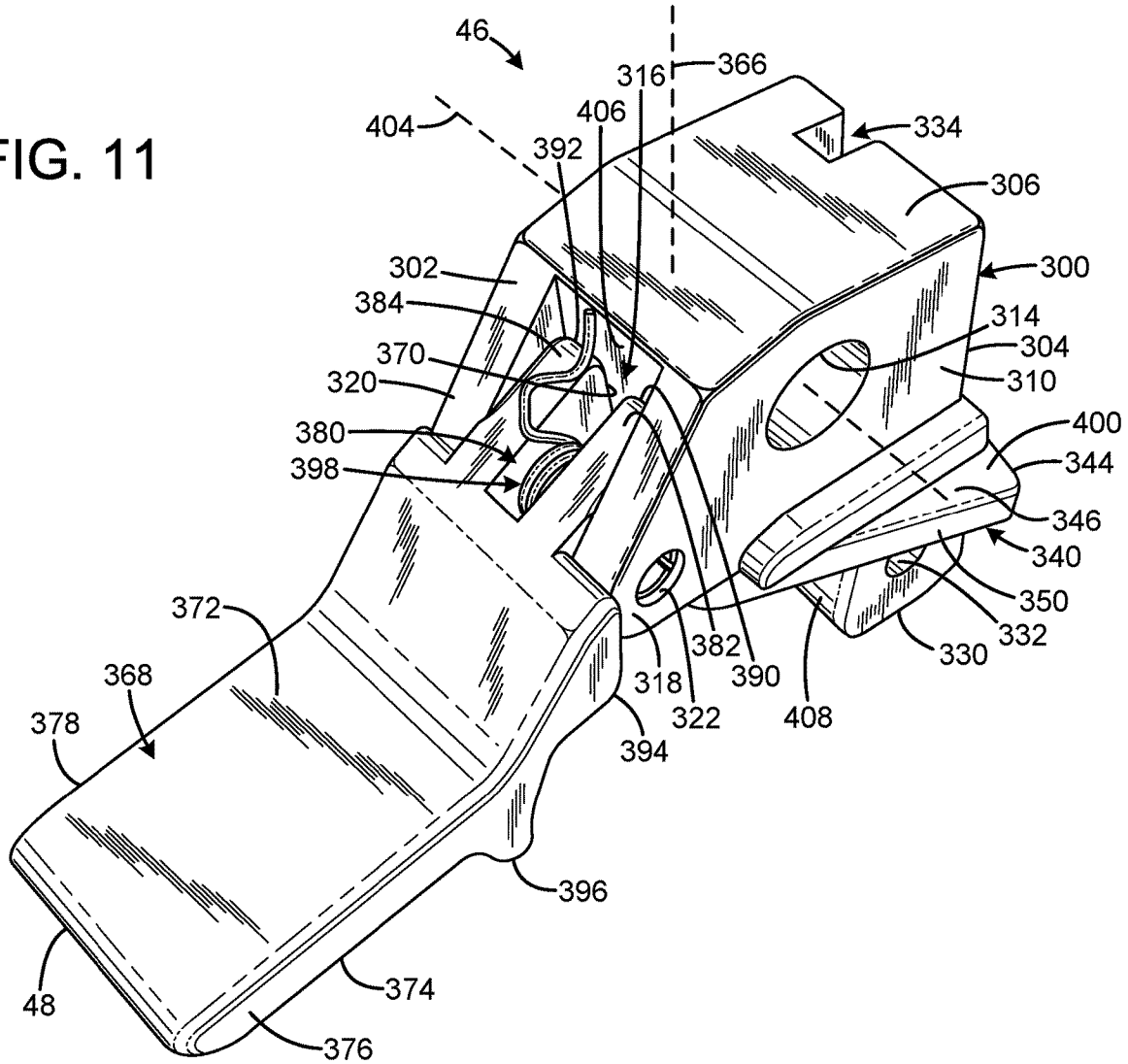
FIG. 11 is a top perspective view of the trigger of FIG. 1 in the folded position.

FIGS. 10 & 11 illustrate the improved folding trigger 46 of the present invention. More particularly, the folding trigger is shown in the folded position. In the folded position, the free end 48 of the trigger lever 368 is securely restrained between the frame 12 and the handgrip 14. Thus, although a small spring 398 (shown in FIG. 9) biases the trigger lever rearwardly, the trigger lever is unable to move rearwardly, rendering the pistol 10 inoperable. Specifically, the trigger lever is unable to move rearwardly, which is connected to the trigger body 300, which is in turn connected to the pistol's trigger bar 262. Therefore, the trigger lever locks the trigger bar in place, making the pistol inoperable. In the case where there are additional safeties based on the movement of the trigger bar, such as a drop safety and plunger safety, by restricting movement of the trigger bar, these additional safeties are also engaged. Since the trigger lever is unable to move rearward, the trigger lever cannot press the trigger body in the right location (against rearward-facing convex safety block element contact surface 394) to defeat the safety block element and allow the trigger body to move backward. Contact between the first body contact surfaces 390, 392 on the trigger lever and a forward contact surface 406 located within the trigger lever slot 316 on the trigger body 300 restrains the trigger body. This contact restrains the trigger body in the forward position because the trigger lever pulls the trigger body to a forward position when the pistol is fully folded (even if the pistol is not chambered). Thus, the first body contact surfaces provide a lockup feature against the trigger body to prevent rearward movement of the trigger body, which keeps the trigger bar 262 (shown in FIG. 7) in tension to prevent the trigger bar from moving rearward to discharge the pistol 10. It should be appreciated that the coil spring 338 ensures a safety contact surface 400 on the top 346 rear 344 of the safety block element 340 always extends beyond the left side 310 of the trigger body 300 unless the trigger lever 368 is being pulled rearwardly.

Figure 12:
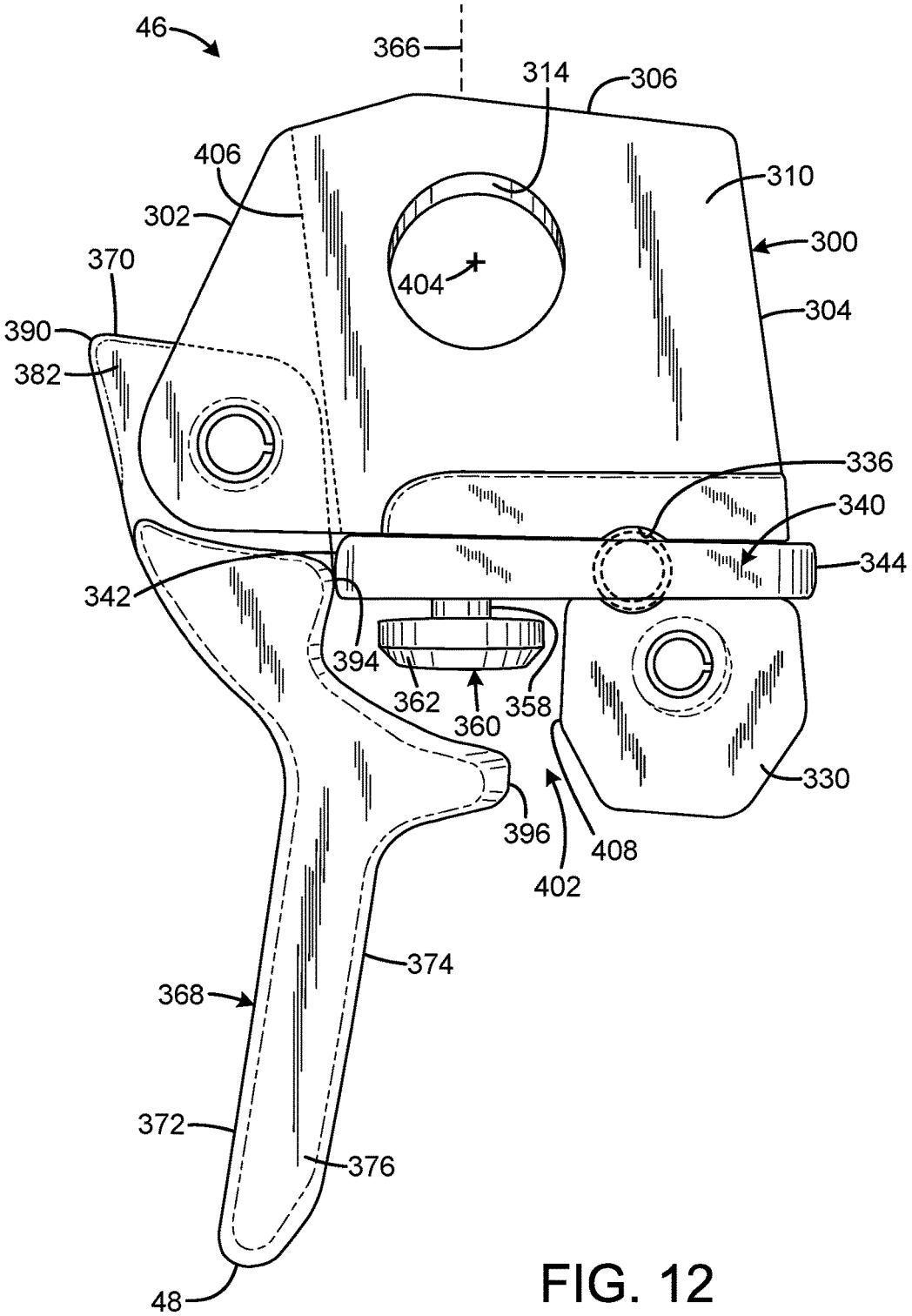
FIG. 12 is a side view of the trigger of FIG. 1 in the ready position.
Figure 13:
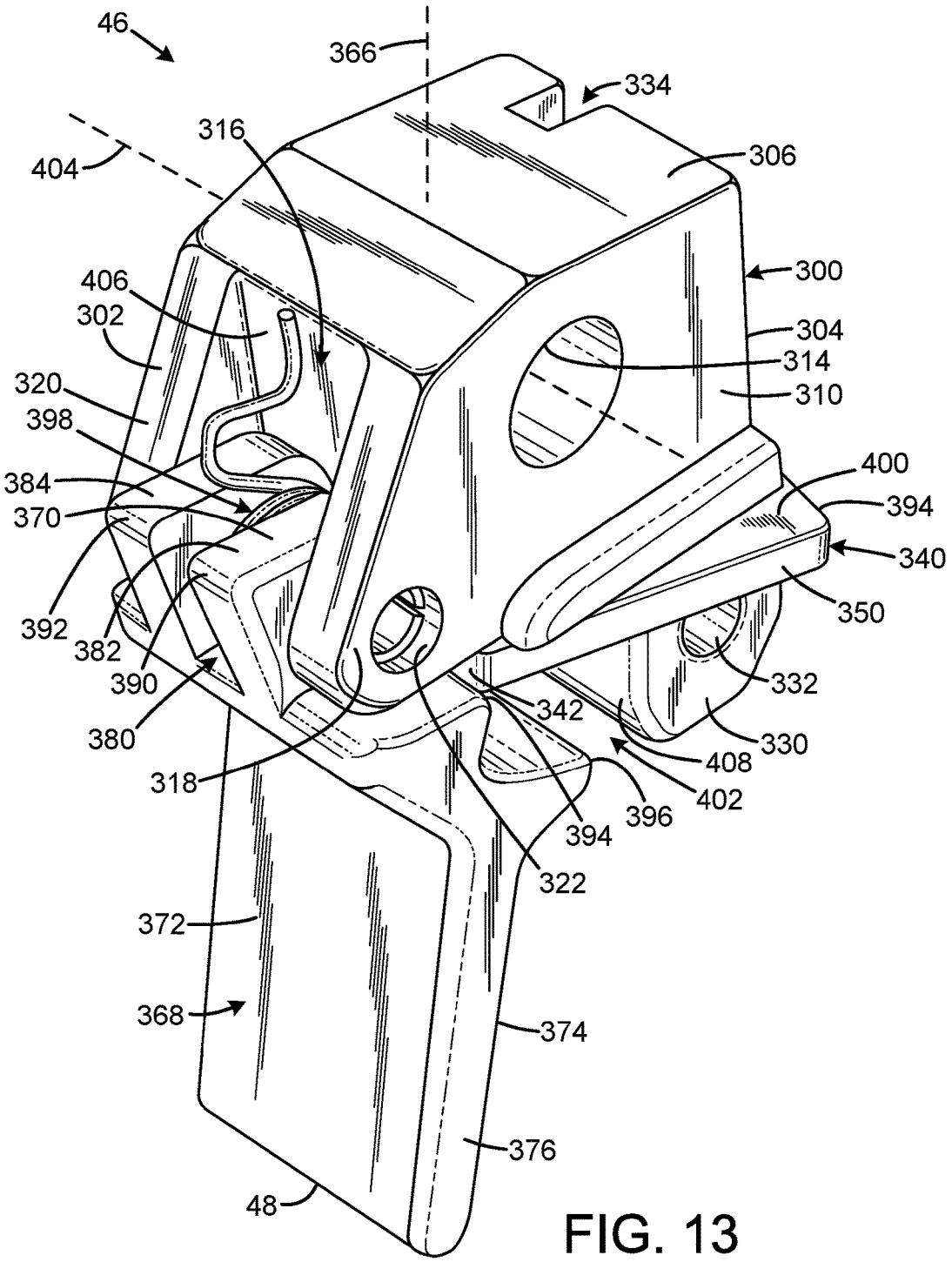
FIG. 13 is a top perspective view of the trigger of FIG. 1 in the ready position.
Figure 14:
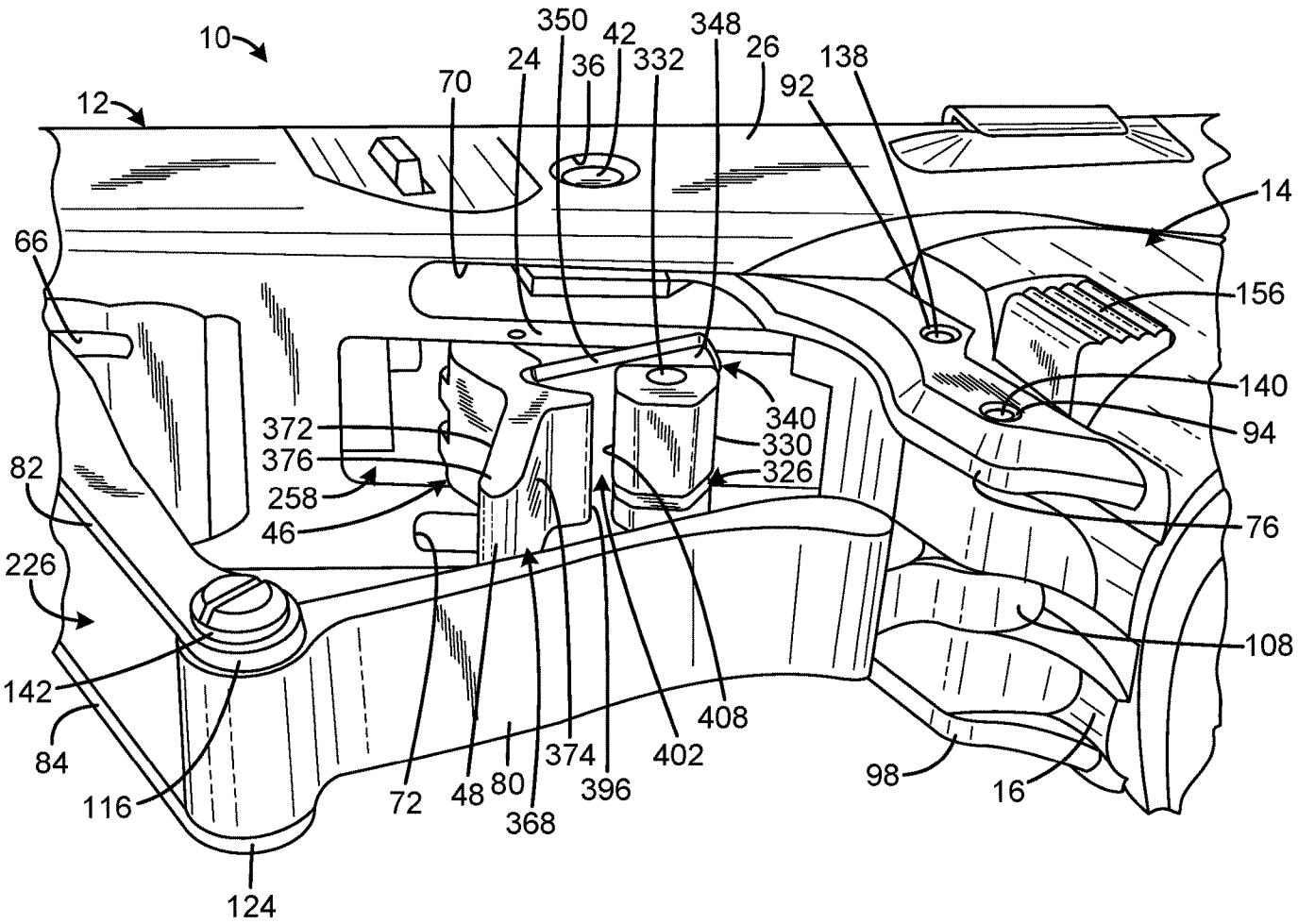
FIG. 14 is a bottom perspective view of the trigger of FIG. 1 in the ready position installed in the folding pistol of FIG. 1.

FIGS. 12-14 illustrate the improved folding trigger 46 of the present invention. More particularly, the folding trigger is shown in the ready position with the handgrip 14 in the extended position in FIG. 14. In this position, the pistol 10 is operable if the trigger lever 368 is pulled rearwardly. The safety block element contact surface 394 on the trigger lever just contacts the left 350 front 342 of the safety block element 340. However, the small spring 398 biasing the trigger lever rearwardly is insufficiently strong to overcome the coil spring 338 that ensures the safety contact surface 400 on the safety block element is exposed. As long as the safety contact surface on the safety block element is exposed, rearward movement of the trigger body is blocked by contact between the safety contact surface and the bottom 24 left side 26 of the frame 12 as shown in FIG. 14. Furthermore, the contact between the safety block element contact surface on the trigger lever and the safety block element ensures a gap 402 exists between the second body contact surface 396 on the trigger lever and the front 408 of the downward-facing protrusion 330 on the trigger body 300.

Figure 15:
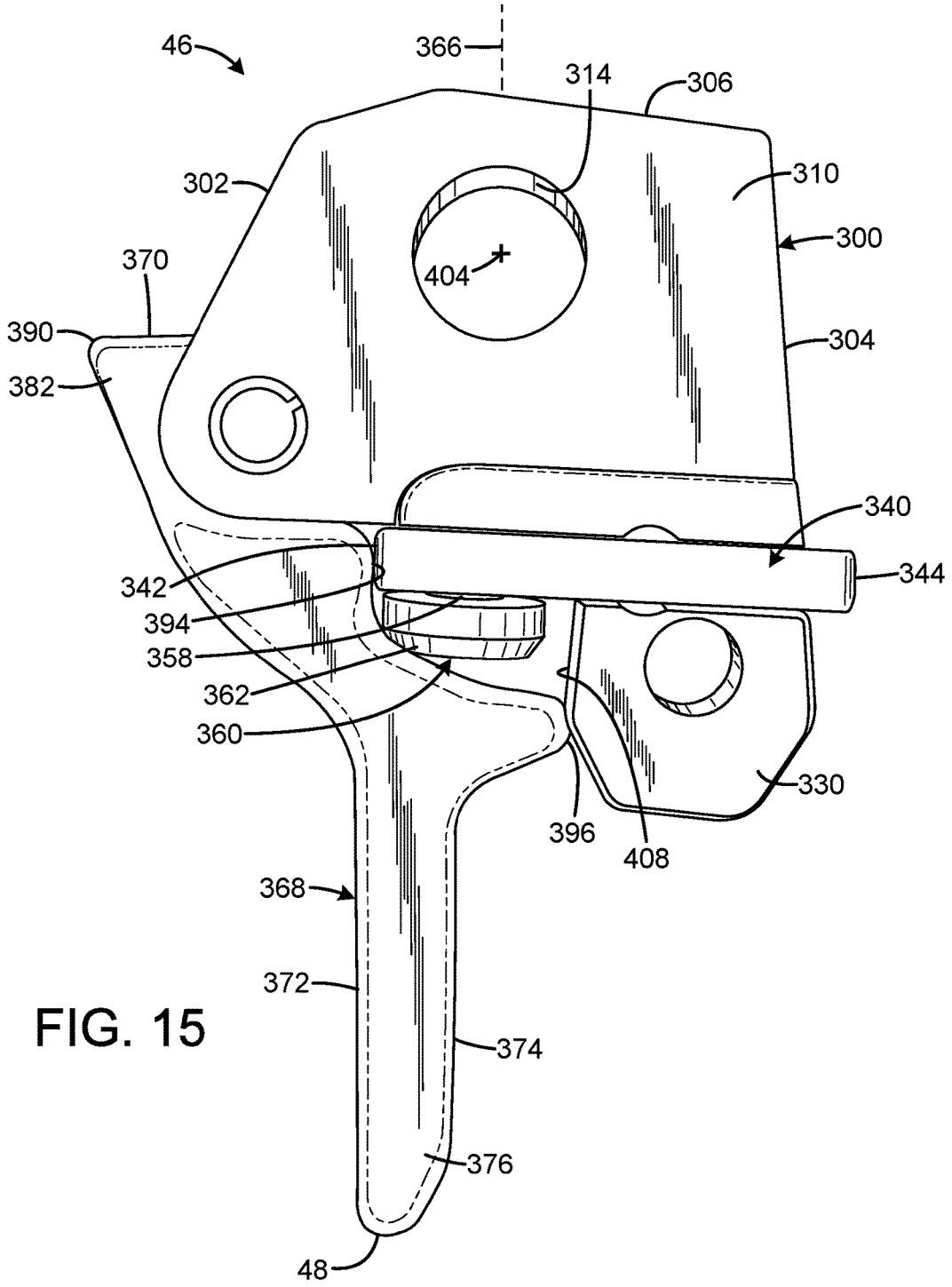
FIG. 15 is a side view of the trigger of FIG. 1 in the engaged position with the safety defeated.
Figure 16:
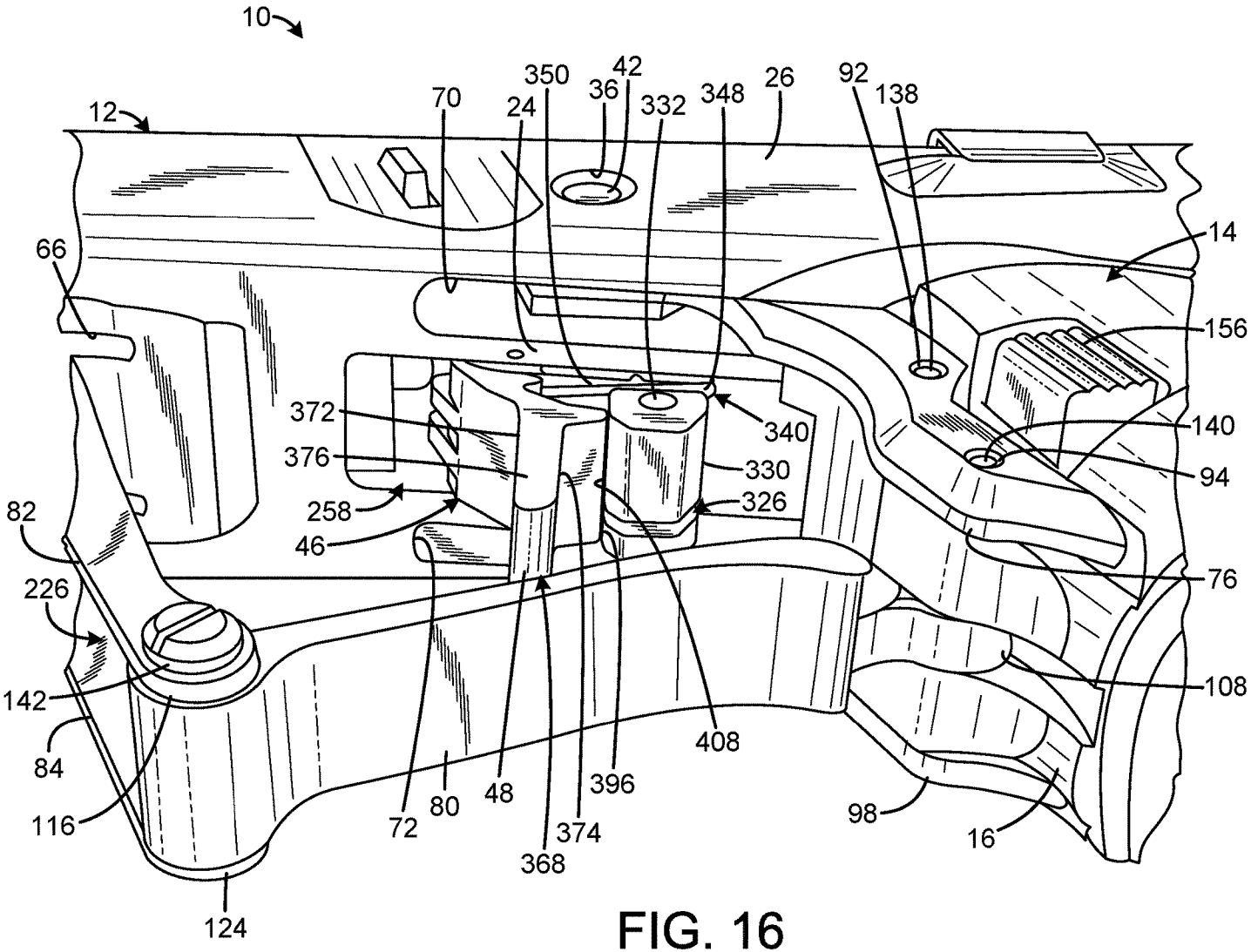
FIG. 16 is a bottom perspective view of the trigger of FIG. 1 in the engaged position with the safety defeated installed in the folding pistol of FIG. 1.

FIGS. 15 & 16 illustrate the improved folding trigger 46 of the present invention. More particularly, the folding trigger is shown with the trigger lever 368 having been pulled sufficiently rearwardly to defeat the safety block element 340. Sufficient pressure of a user's finger upon the front 372 of the trigger lever to overcome the coil spring 338 enables the safety block element contact surface 394 on the trigger lever to act upon the left 350 front 342 of the safety block element 340 to cause the safety block element to pivot about the pivot screw 360. As the trigger lever continues to move rearwardly, eventually the safety contact surface 400 is retracted within the safety block element slot 334. Once the safety contact surface is retracted within the safety block element slot, the trigger body 300 is free to move rearward within the trigger pass through hole 258 (shown in FIG. 3) in the frame 12 (shown in FIG. 2) once the gap 402 is closed between the second body contact surface 396 on the trigger lever and the front 408 of the downward-facing protrusion 330 on the trigger body. The rearwardly protruding second body contact surface 396 is not required because the rearward-facing convex safety block element contact surface 394 rests against the front 342 of the safety block element 340. So, pulling the trigger lever would still disable the safety block element and drive the trigger body rearward. The reason the rearwardly protruding second body contact surface 396 is present is to spread a more even force when driving back the trigger body and reducing any potential wear and tear caused by forces exerted against the small safety block element. Also, the rearwardly protruding second body contact surface 396 could be located closer to the pivot point 314, but it is believed that the further away the contact is from the pivot point, the stronger the contact will be to provide a more direct force to move the trigger body back.

Figure 17:
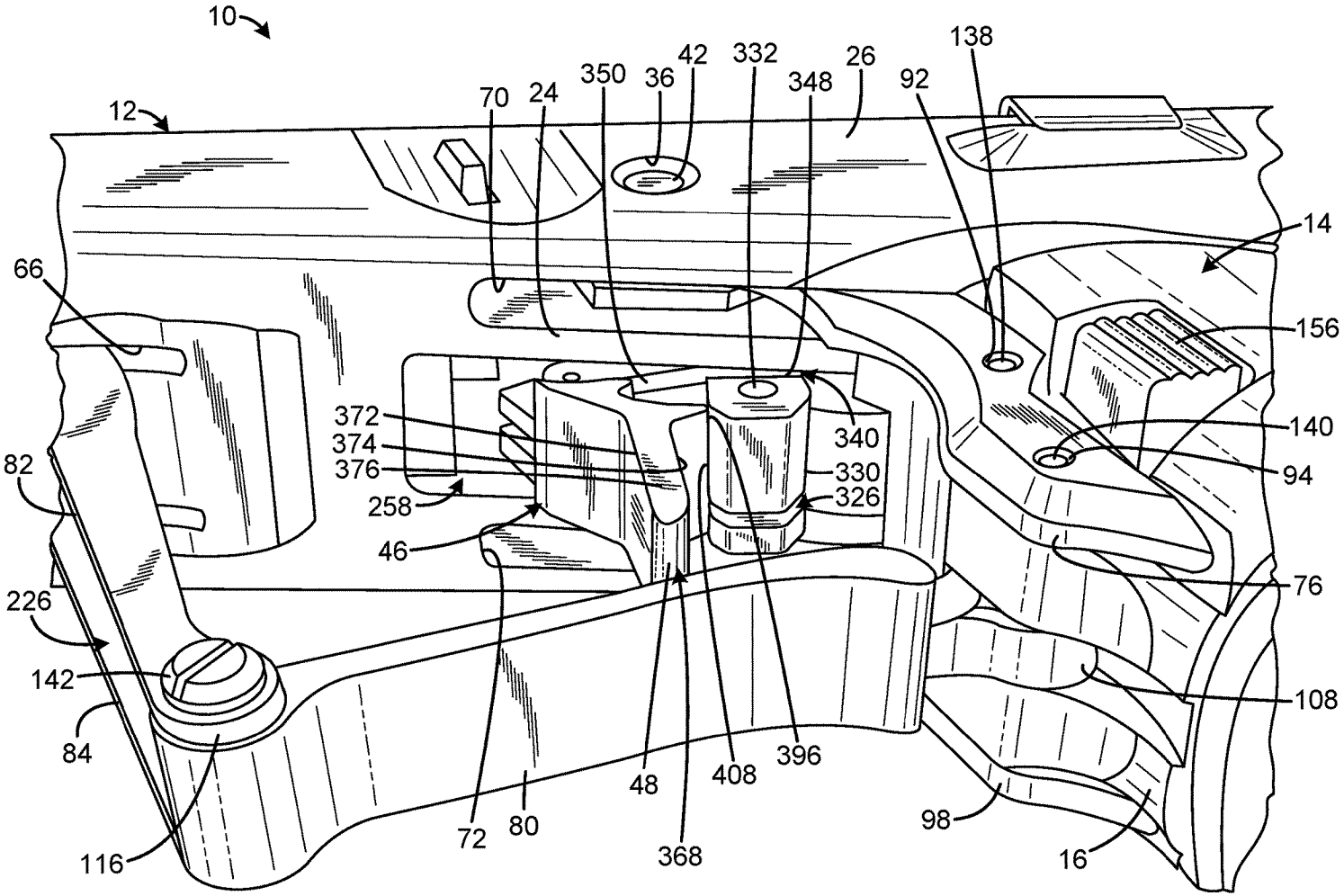
FIG. 17 is a bottom perspective view of the trigger of FIG. 1 in the pulled position installed in the folding pistol of FIG. 1.

FIG. 17 illustrates the improved folding trigger 46 of the present invention. More particularly, the folding trigger is shown with the trigger lever 368 having been pulled sufficiently rearwardly for the trigger body 300 to have been urged sufficiently rearwardly by the second body contact surface 396 on the trigger lever to relieve the tension on the trigger bar 262 and discharge the pistol 10. Once the pistol has discharged, the user releases the trigger lever. Subsequently, the small spring 398 returns the trigger lever to the ready position, and the coil spring 338 exposes safety contact surface 400 to render the pistol safe. Although the trigger lever returns under the influence of the small spring, the trigger body may not return to the ready position (depending on if the it is the last round that was fired, or the user dry-fires the pistol). If the trigger body does not return, then the safety block element never resets to expose safety contact surface 400 to render the pistol safe. But, in order to chamber a round, the user must rack the slide 42, which will always force the trigger body forward. Therefore, the safety contact surface 400 will always be engaged against the sidewall of the frame when there is a chambered round.

Another way to view the return to the ready position process is that once the pistol 10 discharges and cycles a new round, the mechanics of a semi-automatic pistol will push the trigger bar 262 forward once the trigger lever 368 is released. This will move the trigger body 300 back to its ready to fire position, allowing the safety block element 340 to clear the bottom 24 outside of the frame 12, where spring 338 provides constant pressure to the safety block element 340 to push the safety block element surface 400 back out (preventing the trigger body from moving back until the trigger lever is pulled again). If there is no round in the chamber, the trigger body will remain recessed into the pistol's frame until the pistol is cycled (due to manual racking of the slide 42, the loading of a new round, or completely folding the pistol). Therefore, the safety block element can be engaged with or without a round in the chamber depending on these different scenarios. The safety block element can also be engaged by folding the pistol. As the trigger lever is pulled forward, the trigger lever pulls the trigger body forward as the user folds the pistol.

It should be appreciated the firearm frame 12 supports a reciprocating slide 52 and barrel 62. The trigger bar 262 is elongated, connected to the frame, and movable between a bar rear position in which discharge of the pistol 10 is disabled and a bar forward position, with movement to the bar forward position operable to discharge the pistol. The trigger body 300 is connected to the trigger bar and movable between a first body position in which the trigger bar is maintained in the bar rear position and a second body position in which the trigger bar is in the bar forward position. The trigger lever 368 is movable with respect to the trigger body between an extended position in which the trigger lever depends downwardly away from the frame and a folded position in which the trigger lever extends forward along the frame. The first body contact surfaces 390, 392 on the trigger lever are configured to restrain the trigger body in the first body position when the trigger lever is in the folded position, such that discharge is prevented. The trigger lever is restrained in the folded position when the handgrip is in the folded condition. The trigger lever is also restrained even in a partial fold, because if the handgrip is folded at least 30%, the trigger lever will be restrained by the handgrip and not be allowed to contact the trigger body. The first body contact surfaces of the trigger lever face in an opposite direction from the free end 48 of the trigger lever. The trigger lever is configured to restrain the trigger body, and thereby the trigger bar, against discharge as long as the handgrip remains within at least 10° of pivoting from the folded condition. The trigger lever is configured to restrain the trigger body in the forwardmost position. If the trigger body is in a rearward position state, the trigger lever will pull the trigger body to its forwardmost position and restrain the trigger body there as the pistol is folded. The trigger lever does not just restrain the trigger body, but the trigger lever also pulls the trigger body into the forwardmost position even if the pistol has been discharged. The trigger lever is configured to contact the trigger body when the trigger lever is in the extended position and a force is applied (such as from a user's trigger finger). The trigger lever is configured to restrain the trigger body and thereby the trigger bar against discharge as long as the handgrip remains within at least 20° of pivoting from the folded condition. Discharge of the pistol would be enabled once the handgrip reached 26° of pivoting from the folded condition if the safety block element 340 were absent. Some other firearms may have a longer trigger bar travel to discharge the firearm, where the trigger lever would still be restraining the trigger block, thereby restraining the trigger bar to a safe point where the firearm still cannot be discharged even beyond 20° from the folded condition.

The second body contact surface 396 on the trigger lever 368 is configured to contact the trigger body 300 when the trigger lever is in the extended position and to motivate the trigger body to the second body position to discharge the pistol 10 in response to rearward movement of the trigger lever from the extended position. In the extended position, the trigger lever does not automatically contact second body contact surface 396 against the front 408 of the downward-facing protrusion 330 on the trigger body. The safety block element is connected to the trigger body and movable between a safe condition in which movement of the trigger body from the first position to the second position is prevented and an operational condition in which movement of the trigger body from the first position to the second position is enabled. The safety contact surface 400 of the safety block element is configured to contact a portion of the frame when in the safe condition, which prevents the trigger body from moving rearward and recessing into the frame to discharge the firearm. The safety block element pivots on a vertical safety axis 366 perpendicular to a lateral pivot axis 404 of the trigger body. The safety block element is a planar body that abuts a downward facing surface of the trigger body. The forward contact surface 406 on the trigger body is configured to be contacted by a rear surface portion of the trigger lever (the first body contact surfaces 390, 392) only when the trigger lever is in the folded position. The trigger lever is pivotally connected to the trigger body for a range of pivotal movement between a first limit position and a second limit position. The first limit position and second limit position are each established by direct contact between the trigger body and trigger lever to prevent movement beyond the range. The trigger body is received between opposed frame sidewalls (left side 26 and right side 28) The safety block element is configured to contact a portion of the frame (the bottom 24 of one of the opposed frame sidewalls) when in the safe condition (i.e. when the safety contact surface 400 on the safety block element is exposed). It is sufficient if a portion of the safety block element engages any portion of the frame in a manner sufficient to prevent rearward movement of the trigger body.

When the pistol 10 is unfolded and chambered, the trigger pull is like any other pistol, which requires one direction of force. The only way to defeat the safety block element and discharge the firearm with one direction of force is to push the safety block element at exactly one specific point 342, which is an extremely tiny section and highly inaccessible location.

A novel characteristic of the folding trigger of the current invention is that once the handgrip is partially folded (around 20%) so the trigger lever can no longer contact the safety block element 340, the safety block element now requires two simultaneous directions of force that are perpendicular to each other to disable the safety block element and discharge the pistol. The user would have to press the safety block element at point 350 and simultaneously apply a perpendicular force to the trigger body 300 to discharge the pistol. The folding trigger of the current invention was designed so that it would be highly unlikely that any accidental object or situation could occur that would hit that specific point 342 with enough sustained force to defeat the safety block element and move the trigger body back to discharge the pistol.

Furthermore, the folding trigger was designed so the trigger lever starts pulling the trigger body forward as the pistol folds. So as long as the pistol is kept within a certain range of fold (at least 90% fully folded), the trigger lever is pulling the trigger body, which is pulling the trigger bar. If the pistol is retained at least 90% folded, the trigger lever essentially restrains the trigger bar in place. This is another safety feature in addition to the safety block element. So, even if the safety block element were removed, this folded safety would still prevent the trigger body, and hence the trigger bar, from moving rearwardly and discharging the pistol, making the pistol in a safe condition.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a folding pistol has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a Glock 19 Gen4 pistol has been described, it should be appreciated that the principles of the invention can be applied to other Glock pistol models or any other suitable type of pistol. Furthermore, the principles of the present invention can also be applied to a purpose-built firearm or firearm frame having been manufactured with some or all of the required shapes and apertures initially, where fewer or no additional machining steps are needed prior to installation of the components enabling the folding capability and additional safety feature.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A folding firearm with a folding trigger comprising:

a firearm frame supporting a reciprocating slide and barrel;

a grip pivotally connected to the frame and movable between an operational condition and a folded condition;

an elongated trigger bar connected to the frame and movable between a bar rear position in which discharge of the firearm is disabled, and a bar forward position, with movement to the bar forward position operable to discharge the firearm;

a trigger body connected to the trigger bar and movable between a first body position in which the trigger bar is maintained in the bar rear position and a second body position in which the trigger bar is in the bar forward position;

a trigger lever movable with respect to the trigger body between an extended position in which the trigger lever depends downwardly away from the frame and a folded position in which the trigger lever extends forward along the frame; and the trigger lever having a first body contact surface configured to restrain the trigger body in the first body position when the trigger lever is in the folded position, such that discharge is prevented.

2. The folding firearm of claim 1 wherein the trigger lever is restrained in the folded position when the grip is in the folded condition.

3. The folding firearm of claim 1 wherein the trigger lever has a free end and wherein the first body contact surface of the trigger lever faces in an opposite direction from the free end.

4. The folding firearm of claim 1 wherein the trigger lever is configured to restrain the trigger body and thereby the trigger bar against discharge as long as the grip remains within at least 10 degrees of pivoting from the folded condition.

5. The folding firearm of claim 1 wherein the trigger lever is configured to restrain the trigger body and thereby the trigger bar against discharge as long as the grip remains within at least 20 degrees of pivoting from the folded condition.

6. The folding firearm of claim 1 wherein the trigger lever has a second body contact surface configured to contact the trigger body when the trigger lever is in the extended position and to motivate the trigger body to the second body position to discharge the firearm in response to rearward movement of the trigger lever from the extended position.

7. The folding firearm of claim 1 including a safety block element connected to the trigger body and movable between a safe condition in which movement of the trigger body from the first position to the second position is prevented, and an operational condition in which movement of the trigger body from the first position to the second position is enabled.

8. The folding firearm of claim 7 wherein the safety block element has a safety contact surface configured to contact a portion of the frame when in the safe condition.

9. The folding firearm of claim 7 wherein the safety block element pivots on a safety axis perpendicular to a lateral pivot axis of the trigger body.

10. The folding firearm of claim 7 wherein the safety block element pivots on a vertical safety axis.

11. The folding firearm of claim 7 wherein the safety block element is a planar body.

12. The folding firearm of claim 11 wherein the safety block element abuts a downward-facing surface of the trigger body.

13. The folding firearm of claim 11 wherein the trigger body defines a slot receiving the safety block element.

14. The folding firearm of claim 7 wherein the safety block element has a forward contact surface configured to be contacted by a rear surface portion of the trigger lever only when the trigger lever is in the extended position.

15. The folding firearm of claim 7 wherein the trigger body is received between opposed frame sidewalls, and wherein the safety block element is configured to contact a portion of the frame when in the safe condition.

16. A folding firearm with a folding trigger comprising:

a firearm frame supporting a reciprocating slide and barrel;

a grip pivotally connected to the frame and movable between an operational condition and a folded condition;

an elongated trigger bar connected the frame and movable between a bar rear position in which discharge of the firearm is disabled, and a bar forward position, with movement to the bar forward position operable to discharge the firearm;

a trigger body connected to the trigger bar and movable between a first body position in which the trigger bar is maintained in the bar rear position and a second body position in which the trigger bar is in the bar forward position;

a trigger lever movable with respect to the trigger body between an extended position in which the trigger lever depends downwardly away from the frame and a folded position in which the trigger lever extends forward along the frame;

a safety block element connected to the trigger body and movable between a safe condition in which movement of the trigger body from the first position to the second position is prevented, and an operational condition in which movement of the trigger body from the first position to the second position is enabled.

17. The folding firearm of claim 16 wherein the safety block element has a safety contact surface configured to contact a portion of the frame when in the safe condition.

18. The folding firearm of claim 16 wherein the safety block element pivots on a safety axis perpendicular to a lateral pivot axis of the trigger body.

19. The folding firearm of claim 16 wherein the safety block element pivots on a vertical safety axis.

20. A folding firearm with a folding trigger comprising:

a firearm frame supporting a reciprocating slide and barrel;

a grip pivotally connected to the frame and movable between an operational condition and a folded condition;

an elongated trigger bar connected the frame and movable between a bar rear position in which discharge of the firearm is disabled, and a bar forward position, with movement to the bar forward position operable to discharge the firearm;

a trigger body connected to the trigger bar and movable between a first body position in which the trigger bar is maintained in the bar rear position and a second body position in which the trigger bar is in the bar forward position;

a trigger lever pivotally connected to the trigger body for a range of pivotal movement between a first limit position and a second limit position; and the first limit position and second limit position each being established by direct contact between the trigger body and trigger lever to prevent movement beyond the range.

* * * * *